US006661425B1

(12) United States Patent
Hiroaki

(10) Patent No.: US 6,661,425 B1
(45) Date of Patent: Dec. 9, 2003

(54) OVERLAPPED IMAGE DISPLAY TYPE INFORMATION INPUT/OUTPUT APPARATUS

(75) Inventor: Toshihiko Hiroaki, Tokyo (JP)

(73) Assignee: NEC Corporation, Tokyo (JP)

( * ) Notice: Subject to any disclaimer, the term of this patent is extended or adjusted under 35 U.S.C. 154(b) by 391 days.

(21) Appl. No.: 09/640,690

(22) Filed: Aug. 18, 2000

(30) Foreign Application Priority Data

Aug. 20, 1999 (JP) ..... 11-233568

(51) Int. Cl.[7] ..... G09G 5/00

(52) U.S. Cl. ..... 345/629; 345/624; 345/626; 345/204; 345/1.1; 345/1.2; 345/4

(58) Field of Search ..... 345/581, 619, 345/620, 623, 624, 626, 629–632, 797–798, 803, 866, 204, 213, 1.1, 1.2, 1.3, 2.2, 4–7, 43, 781, 854, 578, 13, 700, 708, 714, 716, 759, 764

(56) References Cited

U.S. PATENT DOCUMENTS

| | | | | |
|---|---|---|---|---|
| 5,420,622 A | * | 5/1995 | Faroudja | 348/48 |
| 5,533,183 A | * | 7/1996 | Henderson et al. | 345/854 |
| 5,859,639 A | * | 1/1999 | Ebrahim | 345/788 |
| 5,886,818 A | | 3/1999 | Summer et al. | 359/478 |
| 6,133,892 A | * | 10/2000 | Borgwardt | 345/1 |
| 6,262,694 B1 | * | 7/2001 | Ishimoto et al. | 345/1 |
| 6,366,263 B1 | * | 4/2002 | Takasu et al. | 345/13 |
| 6,441,802 B1 | * | 8/2002 | Tani et al. | 345/1.1 |
| 6,466,237 B1 | * | 10/2002 | Miyao et al. | 345/838 |
| 6,473,058 B1 | * | 10/2002 | Hotomi et al. | 345/1.1 |

FOREIGN PATENT DOCUMENTS

| | | |
|---|---|---|
| JP | 62-122494 | 6/1987 |
| JP | 63-100898 | 5/1988 |
| JP | 63-261978 | 10/1988 |
| JP | 2-76395 | 3/1990 |
| JP | 3-39690 | 2/1991 |
| JP | 3-179995 | 8/1991 |
| JP | 3-226095 | 10/1991 |
| JP | 4-077087 | 3/1992 |
| JP | 4-240693 | 8/1992 |
| JP | 7-287186 | 10/1995 |
| JP | 9-507311 | 7/1997 |
| JP | 10-79906 | 3/1998 |
| JP | 10-123974 | 5/1998 |

* cited by examiner

*Primary Examiner*—Matthew C. Bella
*Assistant Examiner*—Wesner Sajous
(74) *Attorney, Agent, or Firm*—Foley & Lardner

(57) ABSTRACT

An information input/output device having an intuitive operating feeling and improved information viewing and discriminating properties. The device comprises an superposing image extraction unit 101 extracting a portion for superpositional display from an image to output the extracted image portion as an superposing image, a mask pattern generating unit 102 generating a mask pattern, effectors 113, 114 processing the superposing image, and the mask pattern based on the effect designation information, and a base image generating unit 115 synthesizing the mask pattern image and the original image to generate a base image. The device also comprises a switcher 116, brightness/contrast controllers 117, 118 adjusting the brightness or contrast of the display image switching means 112, a control unit 111, superpositional image display unit 124 for superposed demonstration of display image planes of the displays 122, 123 and a display position adjustment mechanism 121. The display information of the image for display in superposition is demonstrated at a position which appears to be floated or recessed from the basic display plane.

21 Claims, 8 Drawing Sheets

OVERLAPPED IMAGE DISPLAY TYPE INFORMATION INPUT/OUTPUT APPARATUS

FIELD OF THE INVENTION

This invention relates to an information input/output vice. More particularly, it relates to an information put/output device for superpositionally displaying an formation displayed on an image plane on another image plane which any other information is being displayed. As will be clarified subsequently, the present invention relates more specifically to an information input/output device in which any other information of plural image planes are presented to a user simultaneously in physically discrete relationship in the vertical direction to contribute to improving the efficiency in the information processing operation.

BACKGROUND OF THE INVENTION

There has so far been known a method for arraying the information in the same plane as an environment in which the information processing operation is performed as variable different information is displayed on an image plane of a display apparatus. This is generally called graphical user interface (GUI). In GUI, there is usually demonstrated on the display image plane (screen) of a display device one or more windows in which to demonstration the information. In this case, the window may be deemed to be a unit of representation for presenting and supervising the information.

Of the plural windows demonstrated on a screen of a display device, in a routine window displaying system, only the window on the foremost foreground has its entire area displayed, whilst the windows hidden behind this window is partially displayed or hidden completely.

Thus, for accessing the hidden window, the window to be demonstrated is activated and moved to the foremost foreground on the screen.

As a result, the window, so far activated, is rendered inactive, by way of interchanging the foreground/background relationship as far as display is concerned.

For demonstrating plural windows on one screen, a user interface is required for quickly specifying or interchanging the respective windows. For example, in Windows (registered trademark of an OS developed by MICROSOFT INC.), switching to the windows to be activated is performed quickly by arranging a window-switching shortcut icon on a task bar or on a desktop or by allocating a window-switching shortcut key to the keyboard.

As another method for presenting plural information on an screen, there is known a method for switchingly demonstrating images. There is also known a method of increasing the volume of the information that can be demonstrated by increasing the image size of the display device and enhancing the resolution or by providing plural display devices to increase the display images.

Also, in a number of application softwares, employing a touch panel display, including, in the first place, an application software employing a touch panel display, a flat GUI is mainly used. As a pointing operation, a button image demonstrated on an image is pressed with a finger on a touch panel, or a mouse button is clicked. Responsive to this actuation, the button image is high-lighted, changed in color, caused to blink or changed to an yielded bit map image.

Meanwhile, among conventional display devices for superposed display of plural images, there are known such a display device employing e.g., a half mirror, and such a display device including an optical device having a similar function, called a flat reflection spectroscope, a combiner or a beam splitter. These optical devices are herein collectively termed a half mirror.

In this type of the conventional devices, there is disclosed in JP Patent Kokai JP-10-123974 a switching display device having a half mirror and configured for displaying two or more image information. The half mirror is adapted for transmitting or reflecting the light radiated from two planar light sources and which has passed through respective transparent tablet plates. There is also disclosed in JP Patent Kokai JP-7-287186 a goggle type display device having two liquid crystal display devices and a half mirror. There is disclosed in JP Patent Kokai JP-10-79906 an arrangement of a liquid crystal television monitor having two liquid crystal display panels, a half mirror for synthesizing two images, a circuit for sampling an image demonstrated on the two liquid crystal display panels and a signal switching switch for supplying sampled image signals to a liquid crystal display panel driver. Moreover, there is disclosed in JP Patent Kokai JP-9-507311 an arrangement of an image synthesizing device for generating a synthesis of plural images/visible phenomena, in which there is provided, from the viewpoint of a viewer, at least one projected real image demonstrated in a neighboring style in a fore-and-aft relation, adjacent to one another, in superposition or in a intersecting relation.

In addition, there is proposed, in JP Patent Kokai JP-04-077087, a stereoscopic image display device in which plural images associated with respective distances form an imaging point to different objects are demonstrated in apparent superposition at plural display positions having respective different optical viewing distances relative to the viewer so that the magnitudes of said optical viewing distances will appear to be the magnitudes of the aforementioned distances, in which the necessity of using special goggles, display units or movable parts of the optical system will be eliminated by arranging plural transparent display units demonstrating plural images at plural display positions.

SUMMARY OF THE DISCLOSURE

The display routinely used for information display is a flat type display, such as CRT or liquid crystal display panel, adapted for displaying plural sorts of the information on a sole plane (image plane, e.g., display screen plane).

In the conventional GUI employing this sort of the display, a window, which may be said to be a virtual paper sheet, as an information management unit, and the text, a bit map image, an operating icon or a menu is arranged on the window.

As an area in which to demonstrate plural windows, there is provided an area termed a "desk top area" which may be said to be a virtual desk surface. On this desk top area the respective windows are arrayed in superposition or arranged as icons to permit a user to prosecute his or her operations.

However, the conventional information display device and the information input/output devices suffer from the following problems.

The first problem is that, if many sorts of the information are displayed on a conventional GUI image plane, it is not easy for the operator to grasp immediately to which point his or her attention should be directed.

The reason is that, in the conventional display device, there is no alternative but to arrange the information on the sole screen plane (image plane) and, if desired to increase the number of the information items to be demonstrated simultaneously, there is no alternative but to reduce the display size of the individual information or to display the information in superposition, as a result of which the information becomes difficult to view for the operator.

If the information to which the attention of the user is to be directed is highlighted, or surrounded by a frame to emphasize the information, the emphasized information is insufficient in definiteness in representation, since the emphasized information is still arrayed on the same plane as the other information.

The second problem is that searching a window hidden behind a foreground window and switching a background window to the foreground represents a cumbersome operation.

In a routine window displaying system, there are occasions where the window on the foreground is displayed in its entirety, whilst the remaining windows are hidden partially or in their entirety by other windows. If the windows are hidden in this manner, a targeted window is difficult to search and, in addition, the information on the other windows are difficult to refer to while the windows or the information represented on the windows cannot be viewed at a glance.

For reliably demonstrating the hidden windows, the window(s) in question need to be activated, however, if plural windows are demonstrated on the same image plane, it is difficult to designate a targeted window directly on the screen.

On the other hand, there are occasions where an image field of a window so far in the active state is rendered inactive, as a result of switching another window into the active state, so that the display on the foreground is changed over to that on the background and vice versa, with a result that the information so far viewed by the user now is hidden behind the active window and hence becomes invisible.

For solving this problem, there is used a method which makes use simultaneously of a user interface for quickly designating or changing over the respective windows. Taking the Windows (registered trademark) as an example, it is retained to be possible to carry out the switching of the active windows quickly by such methods as arranging a window switching shortcut in a general-purpose area such as a task bar, or allocating a window switching shortcut key to a keyboard.

However, these conventional methods are not up to the requirements to demonstrate the plural windows simultaneously.

For demonstrating plural windows simultaneously, the window size may be adjusted to array the windows side-by-side on a sole display screen, one or more displays are added to provide display screens, or the image size may be increased.

However, if the plural windows are arranged side-by-side on a sole image screen, the volume of the information that can be displayed per window is decreased.

If plural display devices are added to add image screens or the image size is increased, the distance (stroke) along which the viewing line of the user in operation is prolonged, such that, in the case of an operation in which respective windows need to be referenced frequently, the load imposed on the operator is increased.

The third problem resides in that, in the display screen switching method, the movement distance (stroke) of the viewing line for the user is the same as before, however, since the user cannot perform an operation o n the display screen as switched, as the he or she refers to the information displayed on the display screen previous to switching, the volume of the information that needs to be memorized by the operator is increased.

The fourth problem resides in that operational feedback which affords the operating feeling to the user cannot be furnished by GUI.

In routine GUI, such as a computer or a communication terminal, a button image arranged on the display screen is planar and, if a user presses the button image, the bit map image is highlighted, changed in color blinking or changed to a recessed bit map image, by way of a feedback operation to the button image pressing operation.

However, these expressions are poor in real feeling as the reply or response to the pressing-down of the button image, such that the user cannot readily grasp or sense whether or not the system has already responded to the operation by the user and hence the user may feel uneasy whether or not his or her operation has been a correct one.

In particular, if, in case of an application software employing a touch panel display, a button image from a touch panel is pressed the pressing-down feeling is insufficient, so that the user is unable to comprehend readily that the system has reacted to the pressing down operation.

The result is that the user cannot confirm readily that his or her previous operation has been a correct one, such that he or she has to press down the touch display with a needlessly large force or an unnecessary number of times.

The fifth problem resides in that it is not presupposed in the conventional superpositional display device that an superposing image plane and an image plane to be superposed present respective different information, the image switching is a mere on/off control, whilst there lacks in the conventional superpositional display device the function of dynamically controlling the brightness and/or contrast of the image required when effectuating stepped switching or superposition of the respective image planes.

In particular, on the side of the image plane of an image to be overlain, overlaid with an overlying portion, the portion to be displayed in superposition is masked to render the portion to be visible more readily. However, this masking processing cannot be performed dynamically to follow up with changes in the superposing information.

It is therefore an object of the present invention to provide an information displaying device whereby an information displayed heretofore on a sole display screen (or image plane) is more comprehensible and the attention of the user may be guided more spontaneously to the crucial information.

It is another object of the present invention to provide a display device in which, if many pieces of information are displayed on a sole display field, which is the crucial information or on which portion focussing is to be applied can be clearly understood, and in which, even if the information and/or the windows are superposed with one another, underlying information can be viewed to a certain extent.

It is still another object of the present invention to provide an information input/output device in which an operating environment with higher operating feeling can be realized for a routine GUI such as a computer or a communication terminal to say nothing of the application software employing a touch panel display.

It is yet another object of the present invention to provide an information input/output device wherein effective superpositional display can be realized between an image plane of an superposing image and an image plane of an image to be superposed, as well as adjustment of brightness or contrast of both the image planes or masking control for the portion to be displayed in superposition can be performed dynamically. Other objects of the present invention will become readily apparent from the following description and the claims.

According to a first aspect of the present invention, there is provided a super positional image display type information input/output device including (a) an image generator unit generating (and outputting) an image (first image) for display in superposition and an image (second image) to be superposed from a given image, and (b) superpositional image display unit providing a (first) display image plane of the image for display in superposition and an image plane of an image to be superposed in separated levels from each other in a superposed state in a manner that the (first) image for display in superposition will appear to be floated on or recessed from a display image plane of the (second) image to be superposed. The superpositional image display type information input/output device according to the present invention further includes a mask pattern generating module generating a mask pattern for the (first) image for display in superposition, and an image generating module generating the (second) image to be superposed from the mask pattern and the given image.

In more detail, according to a second aspect of the present invention there is provided an superpositional image display type information input/output device comprising the following elements (a) to (e)

(a) an image generator unit that extracts a portion to be displayed in superposition from a given image to output an extracted image portion as an superposing image, and that generates (and outputs) a mask pattern for the superposing image;

(b) a first effector unit that receives the superposing image output by the image generator unit, processes the received superposing image with designated image processing in accordance with effect designating information, to output the processed superposing image;

(c) a second effector unit that receives the mask pattern output by the image generator unit, processes the received mask pattern with designated image processing in accordance with the effect designating information, to output the processed mask pattern image, (d) a base image generating unit that synthesizes the mask pattern image output by the second effector unit and the given image to generate and output a base image; and (e) a superpositional image display unit that superpositionally displays the processed superposing image and the base image as demonstrated on first and second display image planes.

According to a third aspect of the present invention, the image generator unit comprises the following elements:

an superposing image extracting module configured for extracting an image portion to be displayed in superposition from an image to be displayed in superposition, in accordance with an superposing area designating information for designating an superposing area on an image, to output an extracted image as an superposing image; and a mask pattern generating module configured for generating a mask pattern based on the superposing area designating information.

Moreover, according to a fourth aspect of the present invention, the image generator unit comprises the following elements:

an superposing information analyzing module configured for generating the superposing image generating information necessary for generating an superposing image and the superposing area designating information in accordance with the superpositional position designating information given as information other than an image;

an superposing image generating module configured for generating and outputting an superposing image in accordance with the superposing image generating information; and a mask pattern generating module configured for generating a mask pattern based on the superposing image generating information.

According to a fifth aspect of the present invention, the image generator unit may comprise:

an superposing image analysis module receiving the superposing information as an superposing image to analyze the shape of the superposing image and an superposing position to generate (and output) the superposing area designating information in accordance with the resulting superposing position designating information, and a mask pattern generating module generating a mask pattern based on the superposing area designating information.

According to a sixth aspect of the present invention, the superposing information is given as an superposing image with a size or an image format which is the same as the size or the format of a given reference image, an superposing display position being pre-set, the superposing image being directly fed to the first effector module. The image generator unit includes a mask pattern generating unit generating a mask pattern based on the superposing area designating information.

According to a seventh aspect of the present invention, there may be provided a brightness/contrast controller configured for adjusting the brightness and/or the contrast of the image for display in superposition and the base image depending on characteristics of the displays, to supply the resultant images to respective displays.

According to a further aspect of the present invention, there may also be provided a switching module configured for switching over control of displays for the image for display in superposition output by the first effector module and the base age output by the base image generating module.

According to the present invention, there may also be provided a switching-over module configured for switching-over between the image for display in superposition output by the first effector module and the base image output by the base image generating module under adjustment of the brightness or contrast of the images.

PREFERRED EMBODIMENTS OF THE INVENTION

Figure 1:
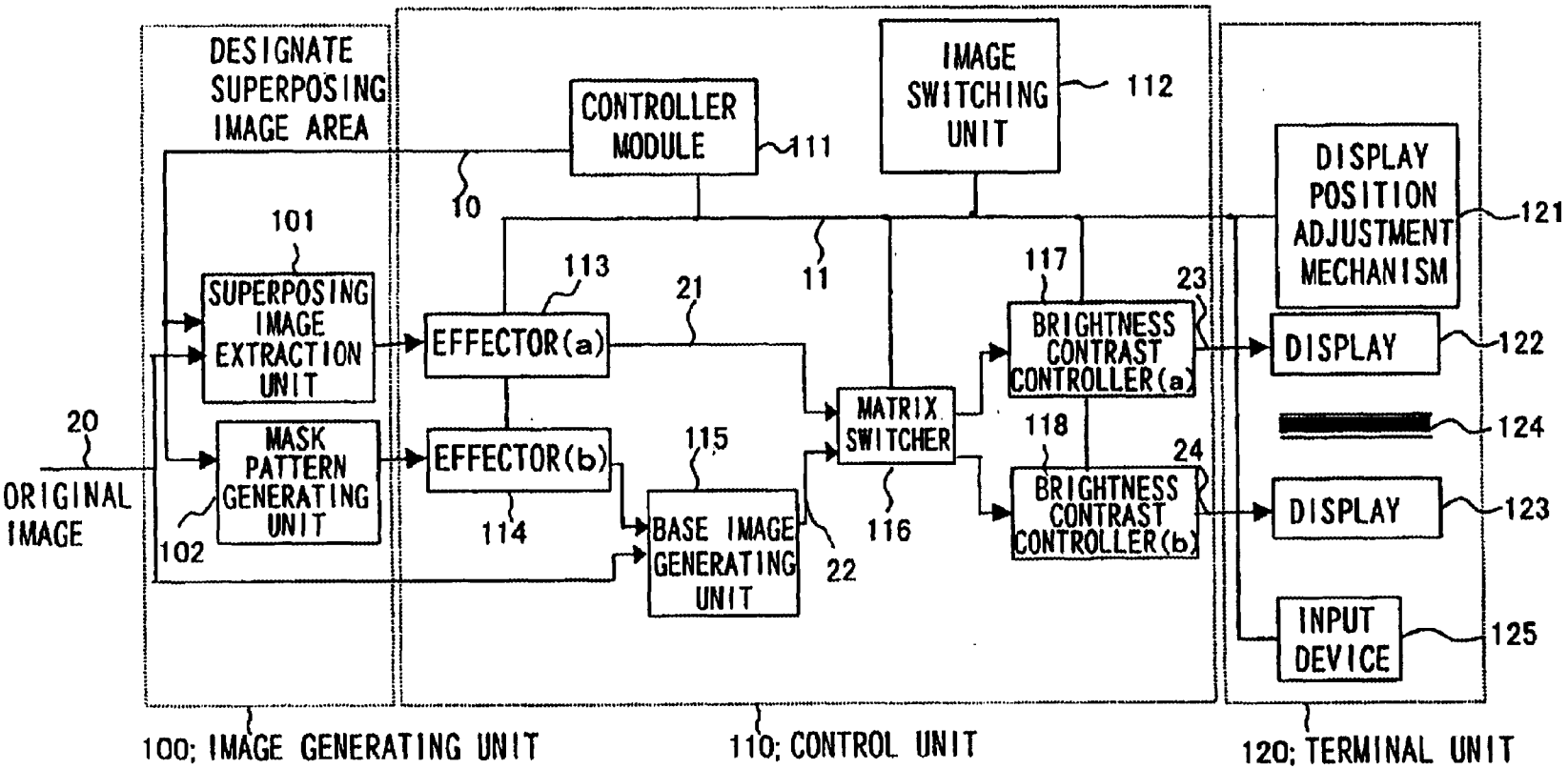
FIG. 1 illustrates an arrangement of a first embodiment of the present invention.

An superpositional image display type information input/output device according to the present invention may include an image generating unit having an superposing image extracting unit for extracting an image portion to be displayed in superposition from an image to be displayed in superposition, in accordance with the superposing area designating information for designating an superposing area on an image, to output an extracted image as an superposing image, and a mask pattern generating unit for generating a mask pattern based on the superposing area designating information. The superpositional image display type information input/output device according to the present invention may also include a first effector unit for receiving the superposing image output from the superposing image extracting unit to process the received superposing image in a specified manner based on the effect designating information to output an image for display in superposition, a second effector unit for receiving the mask pattern output from the mask pattern generating unit to process the received mask pattern in a specified manner based on the effect designating information to output a resulting mask pattern image, a base image generating unit for synthesizing a mask pattern image output by the second effector unit and the original image to generate and output a base image, a switching unit for controlling to which one of displays of a terminal unit the image for display in superposition output by the first effector unit and the base image output by the base image generating unit, a brightness/contrast controlling unit for adjusting the brightness and/or contrast of the image for display in superposition and the base image, sent from the switching unit, depending on characteristics of the display of the terminal unit, to route the images to the displays of the terminal unit, an image switching unit for adjusting the brightness and/or contrast of the image for display in superposition output by the first effector unit and the base image output by the base image generating unit to effect switching control of the image for display in superposition and the base image, and a controlling unit for sending the information designating the superposing area to the image generating unit, for sending the effect designating information to each of the effector units and for designating the switching of the switching unit, wherein the terminal unit includes a first display and a second display, a display position adjustment mechanism for adjusting and holding the position of the first and/or second displays or an image demonstrated on these displays, a superpositional image display unit for demonstrating the image for display in superposition and the base image in an superposed state on the first and second display image planes through first and second displays and an input device.

According to the present invention, there may be furnished operational feedback accompanied by a real operating feeling responsive to the pressing of a button on an image plane (or a display image field).

There may be provided a display environment having superior overview characteristics, in which information retrieval and reciprocal information referencing may be facilitated even if a plurality of information are displayed in superposition. This enables the plural windows to be displayed simultaneously without reducing the window size. Since there is no necessity of activating the window from one referencing operation to another in order to have reference to the underlying information, the operability may be improved. Moreover, since the distance over which the line of sight of the user is to be moved in operation is the same as that in the case of a sole image plane (or sole display screen) in the conventional system, with the result that the operator is fatigued to a lesser extent than if plural image planes (e.g., display screens) are to be handled.

Moreover, according to the present invention, the routine GUI such as a computer or a communication terminal, to say nothing of the application software employing a touch panel display, is furnished as an operating environment accompanied by a more realistic operating feeling, without the necessity of special improvement. For example a realising operating feedback may be furnished to the act of pressing a button on an image plane.

In addition, for realizing effective superpositional display between the superposing image plane and the image plane to be superposed and for furnishing a display environment easier to view and grasp, there is provided a function of controlling the brightness and/or contrast of the image planes and of dynamically effecting masking control for the portion to be displayed in superposition.

DETAILED DESCRIPTION OF THE PREFERRED EMBODIMENTS

An embodiment of the present invention is now explained.

FIG. 1 shows an arrangement of an information input/output device according to an embodiment of the present invention.

Referring to FIG. 1, an information input/output device according to an embodiment of the present invention comprises an image generating unit 110, a control unit 110, and a terminal unit 120. The image generating unit 100 includes an superposing image extracting unit 101 for extracting an image portion of an original image (picture) 20 to be displayed in superposition, in accordance with the superposing area designating information 10 for designating an superposing area on the original image 20, to output an extracted image as an superposing image, and a mask pattern generating unit 102 for generating a mask pattern based on the superposing area designating information.

The control unit 110 may include a first effector unit 113 for receiving the superposing image output from the superposing image extracting unit 101 to process the received superposing image in a specified manner based on the effect designating information to output an image for display in superposition, a second effector unit 114 for receiving the mask pattern output from the mask pattern generating unit 102 to process the received mask pattern in a specified manner based on the effect designating information to output the resulting mask pattern image, a base image generating unit 115 for synthesizing the mask pattern image output by the second effector unit 114 and the original image 20 to generate and output a base image, a switching unit (matrix switcher) 116 for controlling to which one of displays of a terminal unit the image for display in superposition output by the first effector unit and the base image output by the base image generating unit is to be routed, brightness/contrast controlling units 117, 118 for adjusting the brightness and/or contrast of the image for display in superposition and the base image, sent from the switching unit 116, depending on characteristics of the display of the terminal unit 120, to route the images to the displays of the terminal unit 120. There is also an image switching unit 112 for adjusting the brightness and/or contrast of the image for display in superposition output by the first effector unit 113 and the base image output by the base image generating unit 115 to effect switching-over control of the image for display in superposition and the base image. A controlling unit 111 is configured for sending the information designating the superposing area to the image generating unit, for sending the effect designating information to each of the effector units and for designating the switching-over of the switching unit 116.

The terminal unit 120 includes a first display 122 and a second display 123, a display position adjustment mechanism 121 for adjusting and holding the position of the first and/or second displays or an image demonstrated on these displays, superpositional image display unit 124 for demonstrating the image for display in superposition and the base image in a superposed state on the first and second display image planes, via the first and second display image planes, via the first and second displays, and an input device 125.

In a preferred embodiment of the present invention, the image plane for display in superposition and the image plane to be superposed, referred to as "a base image plane", are arrayed (or layered) physically separated from each other to improve the viewing and discriminating properties of the information demonstrated on a target image plane for display in superposition.

By adjusting the brightness and/or contrast of the target image plane for display in superposition and the base image, the two information can be furnished simultaneously. For example, if the brightness or the contrast of one of the information is lowered in a well-balanced fashion, the information can be furnished without obstructing the display of the other information.

By dynamically controlling the brightness and/or contrast of the image plane with respect to the operating contents of the user or the crucial point, not only can the image planes be changed over smoothly, but also the two image planes can be perpetually displayed during the change over time. So, if cross-reference is being had between the two image planes, the origin of reference and the destination of reference are displayed simultaneously to relieve the user of the load in memorizing the displayed contents as well as to enable an operation to be executed efficiently.

For example, an inactive window may be displayed dimly in a see-through fashion behind an active window.

Moreover, the switching of image planes, that is brightness and/or contrast of two image planes, may be exclusively controlled, that is control may be managed so that, if one of the image planes is lighter, the other image plane may be darker. By performing the above control stepwise, the image plane can appear to be switched stepwise, thus giving an impression that the image plane switching is occurring continuously to alleviate the extraneous feeling otherwise imparted to the user.

According to the present invention, the two image planes can be presented physically separated, in level or depth of image, from each other to split a sole image field consisting of a sole image plane into two image planes, to present each image on each image plane.

If the two images are intended to be presented simultaneously, the two image planes are presented physically separated from each other to improve the discriminating properties for the superposed information as compared to the conventional technique in which two images are superposed on a sole image plane. These discriminating properties become the higher the more the two image planes are separated from each other.

Moreover, if the two image planes are presented physically separated from each other, the specified information, desired to be emphasized, can be extracted from the information heretofore degraded into a sole image plane, and can be displayed floated as an superposing image. Specifically, the particular information can be extracted from the conventional image plane (or field) and displayed in a physically floated condition.

So, a display environment can be furnished in which the conventional GUI image plane is expanded directly to emphasize the information more comprehensively.

Moreover, by adjusting the relative positions (levels) of the image planes, such a display effect, in which the information is sunk from the image plane, can be realized. In this case, the image plane portion, left after extracting the information, desired to be emphasized, can be masked and displayed in superposition to emphasize superposed display more pronouncedly.

The masking processing is applied to an area i e., a portion of display in superposition projected on the base image plane. If the image for display in superposition and the mask pattern are changed in concert (or inassociation each other), variable rendition of the superposed display, such as a so-called wipe effect, in which the information is gradually changed between the image planes, can be performed to attract the attention by the user, to alleviate the extraneous feeling accompanying the mode switching of the image plane or the system mode.

If, in presenting two image planes physically separated from each other, the respective images displayed on the respective image planes can be correlated and associated with the operation by the user to realize a more intuitive operating environment. If, for example, the image of a button that can be pressed down is arranged on an upper image plane, and a base image plane is arranged on a lower image plane, an impression can be produced in which only the button is floated from the base. The user is able to realize intuitively from the display contents as to which portion of the image plane is to be pushed.

If, when a specified button image is pressed, the bit map of the button image is erased from the upper image plane, and drawn on the lower base image plane, an impression is produced as if the button has moved from the upper to the lower sides to help realize the actual feeling of pressing the button.

Figure 2:
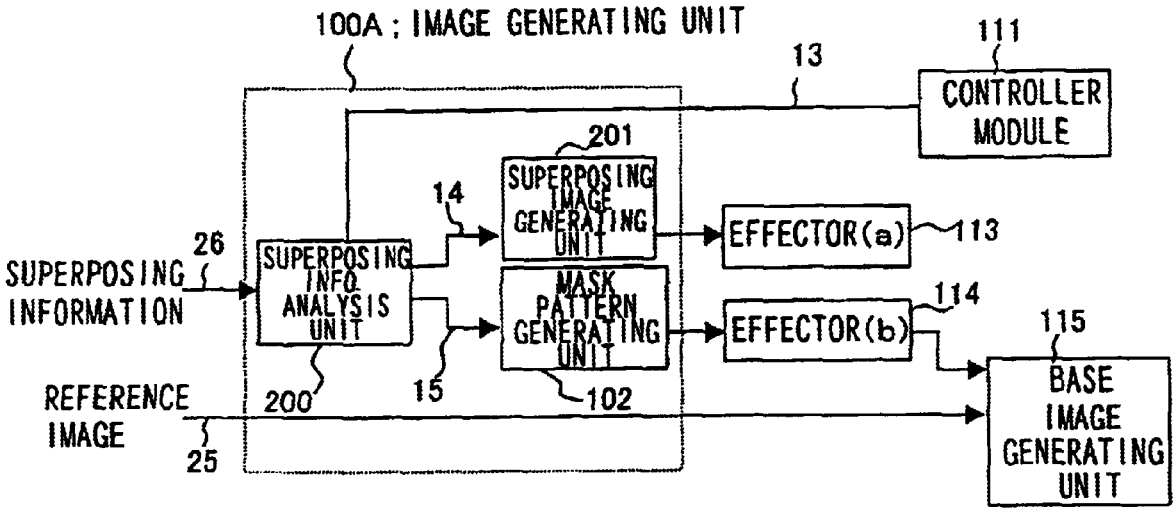
FIG. 2 illustrates an image generating unit and its peripheral structure according to a second embodiment of the present invention.

In a preferred embodiment of the present invention, shown in FIG. 2, the image generating unit 100A includes an superpositional information analysis unit 200 for generating the superposing area designating information 14 and the superposing area designating information 15 in accordance with the superposing position designating information 13 adapted for giving an information other than that for an image, an superposing image generating unit 201 for generating and outputting an superposing image in accordance with the superposing image generating information, and a mask pattern generating init 102 for generating a mask pattern based on the superposing area designating information.

A base image generating unit 115 synthesizes a mask pattern image output by the second effector unit 114 and a reference image 25 to generate and output a base image.

Figure 3:
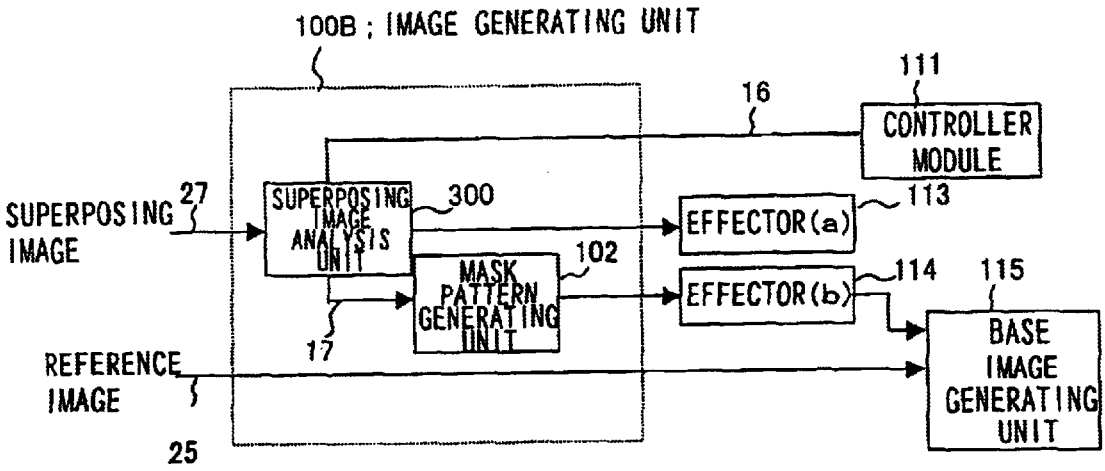
FIG. 3 illustrates an image generating unit and its peripheral structure according to a third embodiment of the present invention.

An image generating unit, as another embodiment of the resent invention, shown in FIG. 3, the image generating unit 100B includes an superposing image analysis unit 300 fed with the superposing information as an superposing image to analyze the shape and the superposing position of the superposing image to generate and output the superposing area designating information in accordance with the superposing position designating information, and a mask pattern generating unit 102 for generating a mask pattern based on the superposing area designating information.

Figure 4:
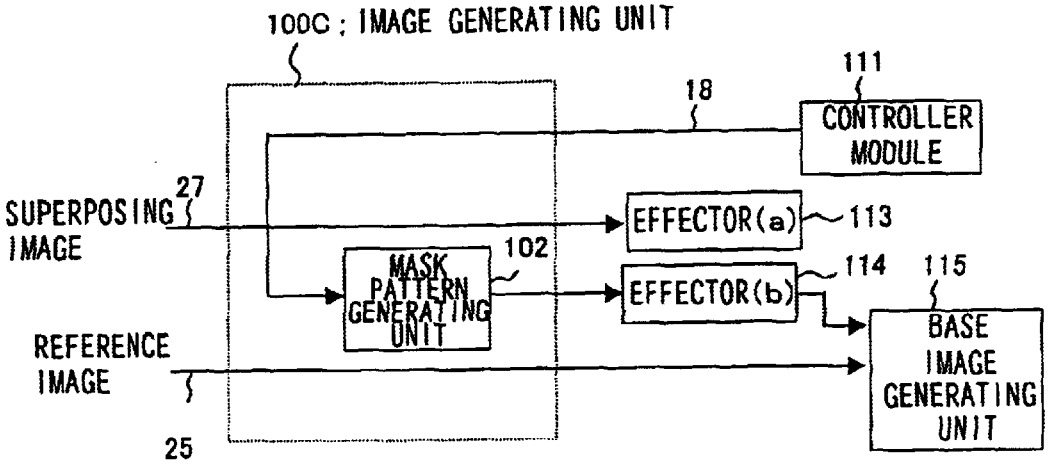
FIG. 4 illustrates an image generating unit and its peripheral structure according to a fourth embodiment of the present invention.

An image generating unit 100C, as another embodiment of the present invention, shown in FIG. 4, the image generating unit includes a mask pattern generating unit 102 fed with the superposing information as an superposing image which is given as the same size or image format as those of a reference image, with the position for superposed display being set. The mask pattern generating unit 102 generates a mask pattern based on the superposing area designating information.

Figure 5:
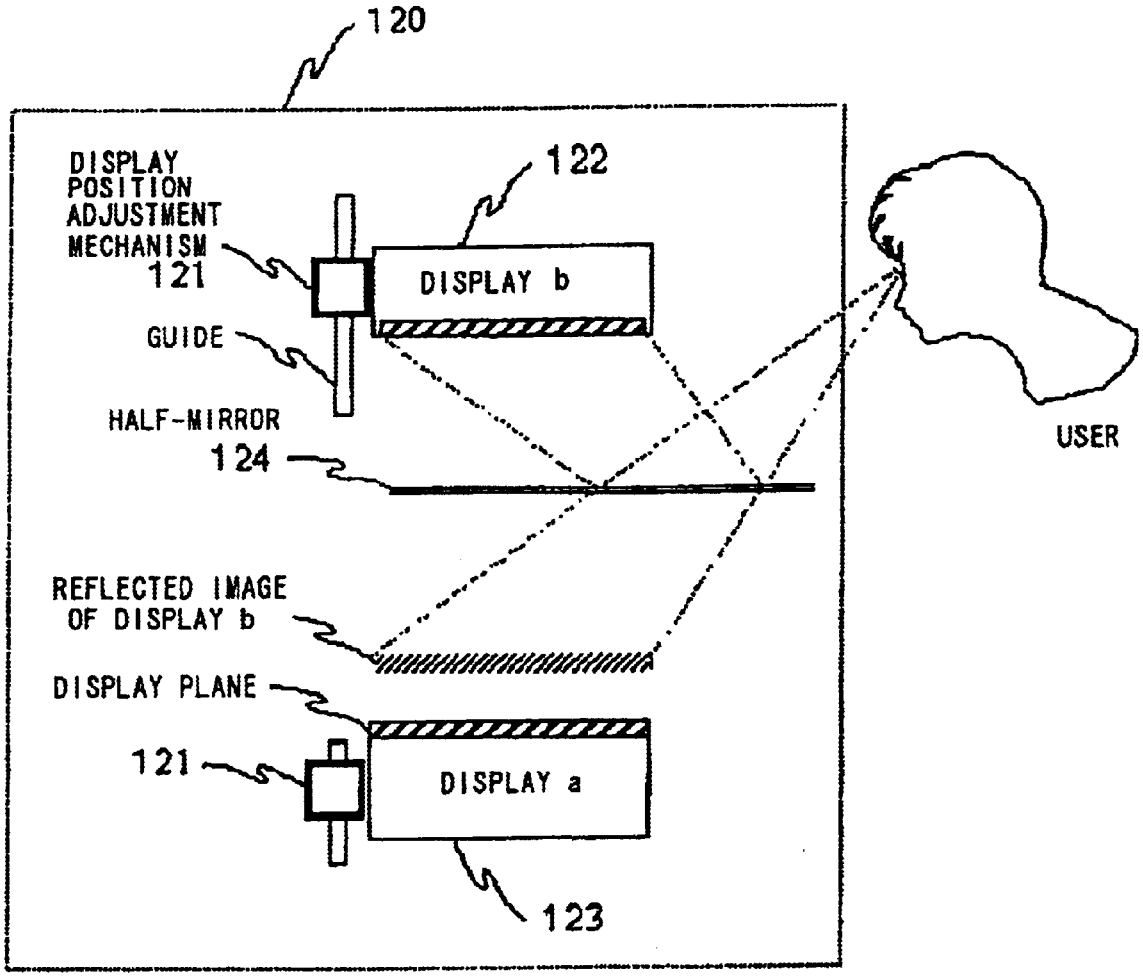
FIG. 5 illustrates the structure of a terminal unit in case of using a half mirror as an image superpositional display unit in the first embodiment of the present invention.

In another preferred embodiment of the present invention, shown in FIG. 5, the superpositional image display unit 124 is a half mirror 124 on one side of which a first display (a) 122 is arranged facing a surface of the half mirror 124. A second display (b) 123 is arranged facing an opposite surface of the half mirror 124. The information for display in superposition is displayed in superposition on the base image plane as a reflected image of the display (b), i.e., the image of the superposing image, to provide an elevated display image plane above the display plane of the first display (a).

It should be noted that the dimensional/spacial configuration can be modified based on the essential optical or physical superpositional relationship illustrated herein.

In the preferred embodiment of the present invention, shown in FIG. 5, the superposing image display unit 124 is a stacked arrangement of the first and second displays 123, 124. The information for display in superposition may be displayed in superposition on the base image plane. A display position adjustment mechanism 121 adjusts the spacing between the first and second transmission displays 122, 124.

In a preferred embodiment of the present invention, the display for demonstrating the base image is a display provided with a touch device.

EXAMPLES

For more detailed description of the above-described embodiments of the present invention, examples of the present invention will be explained in detail with reference to the drawings.

The definition of terminology used in the present description is as follows:

"Superposing information" means the information desired to be displayed in superposition.

"Information to be superposed" means the information on which the superposing information is to be displayed in superposition.

"Original image" means an image containing both the superposing information and the superposed information.

"Superposing image" means the superposing information represented as an image.

"Image to be superposed" means the information to be superposed, represented as an image.

"Image for display in superposition" means a superposing image actually sent to display for superpositional display.

"Base image" means an image to be superposed (e.g., underlying image), actually sent to the display.

Meanwhile, whether the information is to be the superposing information or the information to be superposed is optionally determined depending on to which information the attention is to be directed, which information is more crucial, which information is more voluminous, the relative display sizes, the objective or intention of rendition in information presentation, and so on. The positional relationship between the superposing information and the information to be superposed is to be designed in connection with the objective in the expression or the intention of rend it ion in practicing the present invention, such that it is not mandatory to display the superposing information ahead or above the information to be superposed.

The "image" denotes not only a still image such as photo or bit map image, but also moving images such as letters, graphics, animation or video image. The image is not limited to a raster image such as one projected on a CRT device, but may be of such a display configuration in which pixels of a liquid crystal, plasma display or a projector are arranged over the entire display surface.

The "image plane" means a display plane and/or an image (plane) demonstrated on the display plane, including a reflected or projected image plane (i.e., either real or virtual).

Although the image plane size (field size) will be discussed subsequently, the image plane size herein is assumed to be of the same size for plural displays. If the image plane size is different, it is sufficient if each image is multiplied by an appropriate factor for image size enlargement or reduction for demonstration as necessary so that the images will be of the same apparent size.

In the following, a method in which an image is transmitted sequentially through respective functional blocks so that respective image processing operations will be performed on a video memory on each functional block is explained by way of an example. However, such a configuration may also be used in which respective functional blocks in an apparatus share a video memory, which may be a sole video memory having an entire video memory area or a sole video memory having its memory area split into plural sections to which different functions or image planes are allocated, with the respective functional blocks accessing the video memory sequentially or in parallel by time-division multiplex processing to process the image. If the equivalent functions can be implemented by analog signal processing, it is unnecessary to use the digital processing of exploiting the video memory.

FIG. 1 shows a first embodiment of the present invention where there is shown an arrangement of a superpositional image plane demonstration type information input/output apparatus.

Refer ring to FIG. 1 the superpositional image plane image plane demonstration type information input/output apparatus, according to the first embodiment of the present invention, includes an image generating unit 100, a control unit 110 and a terminal unit 120.

The image generating unit 100 includes an superposing image extraction unit 101 and a mask pattern generating unit 102. The control unit 110 is made up of a controller 111, an image switching unit 112, effectors 113, 114, a base image generating unit 115, a switching unit 116 and brightness/contrast control units 117, 118. The terminal unit 120 is made up of a display position adjustment mechanism 121; displays 122, 123, superposed image display means 124 and an input device 125. The switching unit 116 is constituted by, for example, a matrix switcher.

The image generating unit 100 is a functional block for generating an superposing image and a mask pattern. The superposing image extraction unit 101 extracts an image portion to be displayed in superposition, from an original image 20, in accordance with a superposing (e.g., overlying) area specifying information 10, and sends the extracted image portion as an superposing image to the effector 113.

The mask pattern generating unit 102 generates a mask pattern, based on the superposed area specifying information 10, to send the generated mask pattern to the effector 14.

The superposing area specifying information 10 is the information specifying a port ion or an area on the original image for demonstration in superposition for emphasis.

This superposing area specifying information 10 is represented by at least one of the following:

- a set of coordinate values specifying pixel positions on an original image;
- a set of vectors specifying a particular area in the original image;
- parameters specifying the particular shape of a primitive representing a particular shape associated with the original image, such as a rectangle, a circle or a polygon;
- bit map data associated with the original image;
- a set of addresses on a video memory which has captured an original image; and
- the image information which has specified the alpha-plane or particular chromatic components in the original image.

The control information for generating an superposing image from an original image may be contained in the superposing area specifying information.

In extracting an image portion for demonstration in superposition from the original image, the original image is split into two parts, one of which is sent to the base image generating unit 115 adapted for generating the image to be superposed and the other of which is sent to the superposing image extract ion unit 101.

The superposing image extraction unit 101 includes a work video memory, a frame buffer or a frame memory, with the original image being expanded on the video memory. The information is extracted from the specified area of the video memory, in accordance with a command by the superposing area specifying information 10, and constructs the extracted information as a superposing image, which superposing image is routed to the effector (unit) 113.

The mask pattern denotes image data which is to be superposed on the image to be superposed for high-lighting the superposing information over (as contrasted to) the information to be superposed. For high-lighting the superposing information, it suffices in general to lower the brightness or luminance of the information to be superposed corresponding to the portion to be high-lighted. The mask pattern is prepared as the information which is of the same size and shape as the superposing information and which serves for decreasing the alpha value.

The controller 111 manages control to route an image for display in superposition (first image) 21 and a base image (second image) 22 from the base image generating unit 115 through the switching unit 116 and the brightness/contrast controllers 117, 118 to respective displays 122, 123 of the terminal unit 120.

On reception of the superposing image from the superposing image extraction unit 101, the effector 113 performs specified image processing to route the image for display in superposition 21 to the switching unit 116. The mask pattern supplied from the mask pattern generating unit 102 is processed in the effector 114 as specified by the controller 111 and is thence routed to the base image generating unit 115.

The base image generating unit 115 synthesizes the mask pattern image sent from the effector 114 to the original image 20 to generate the base image 22, which is routed to the matrix switcher 116.

The matrix switcher 116 switches between the image for display in superposition 21 and the base image 22, under designation and control by the controller 111, to route the images to the brightness/contrast controllers 117, 118.

The brightness/contrast controllers 117, 118 adjusts the brightness and/or contrast of an image sent from the matrix switcher 116, under designation and control by the controller 111, to route the images to the displays 122, 123.

The effectors 113, 114 execute:

- color tone correction for an image (adjustment of brightness and/or contrast, gamma correction, adjustment of the hue, saturation, color tone, gradation, white balance or color balance etc):
- image processing or calculations (multiplication, addition, subtraction, overlay, comparison, covered baking, burning, inversion etc);
- trimming;
- variable working or filtering effects (moire, noise addition or sharpness)
- deformation or rotation; and
- wipe switching (or interchanging) while converting the image mode or format, resolution or size, upon necessity.

It is unnecessary for the effectors 113, 114 to have all of these functions. That is, the desired functions may be selectively provided as appropriate depending on the usage or the targeted effect.

If the usage is such that only routine processing suffices in the effectors 113, 114, effect processing can sometimes be uniquely applied in accordance with a predetermined command. However, if more complex processing is required or if the application software in its entirety is in need of processing a specified task the effectors 113, 114 operate as commanded by the controller 111.

The base image generating unit 115 synthesizes the mask pattern and the original image. This synthesis may be achieved by for example,

- overwriting the mask pattern directly on the original image;
- overwriting a mask pattern on an alpha plane of the original image; or
- by executing logical product processing on the original image and the mask pattern and by outputting the results of the processing as the base image.

The matrix switcher 116 manages control to which displays in the terminal unit the image for display in superposition and the base image are to be routed.

The reason the matrix switcher 116 is arranged in this manner is that, when the positions of the displays 122, 123 are fixed and the image planes are demonstrated at physically discrete positions (levels), such as at an upper (elevated) level and at a lower (deeper) level, the image needs to be demonstrated in a switching-over fashion between upper and lower levels.

If the image display position cannot be changed quickly by the display position adjustment mechanism, the upper and lower-level images can be interchanged instantly by interchanging the image outputting destination to extend the latitude (scope) in expression of information presentation.

If the usage is such that only routine processing suffices in the matrix switcher 116, switching processing is executed in the matrix switcher 116 in accordance with a predetermined command. However, if more complex processing is required, or if the application software in its entirety is in need of processing a specified task, the matrix switcher 116 operate as commanded by the controller 111.

If it would be necessary to synthesize the image for display in superposition and the base image to a sole image plane which is output and displayed, it would suffice if an image mixer is connected to the matrix switcher 116 as an external processor for bypass processing or if an image synthesizing function is imparted to the matrix switcher 116. This function (image synthesizing function) is effective for such usage in which an image plane is recorded or an image plane is demonstrated to a larger (projected) size on a conventional display different from the apparatus of the instant embodiment.

The brightness/contrast controllers 117, 118 have the function of statically or dynamically changing the brightness and/or contrast of an image transmitted from the matrix switcher 116.

Although the brightness and/or contrast can be controlled separately, it is also possible to adjust the brightness and the contrast in an interlinked fashion. This interlinked adjustment is effective if, when desired to switch the image plane abruptly or to display an image dimly on the background while another image is displayed in an emphasized manner, the information is to be lowered in clarity whilst certain brightness is maintained.

The purpose of the brightness/contrast controllers 117, 118 is to adjust the demonstrating characteristics of the display in the terminal unit 120, to adjust the display balance between the image for display in superposition and the base image and to effect display switching.

The adjustment of the demonstrating characteristics of the display means.

- adjusting the difference in characteristics of plural displays due to machine species or due to difference among the indivisual displays;
- cancelling the effect of reflection by a half-mirror; or
- correcting inherent characteristics due to time changes as from power up of the display, chronological changes or difference in the display system due to difference in ambient brightness, such as difference due to whether the display device is of the autogenous light emission type or of the reflection type.

The adjustment of the display balance between the image for display in superposition and the base image corrects the difference in brightness and/or contrast caused by different image processing steps following extraction of the superposing image from the original image.

If the superposing image is given separately from the image to be superposed, the brightness or the contrast tends to become unbalanced due to the difference in image sources. So, it is effective to perform corrections of alleviating the extraneous feeling in case of display in superposition in the brightness/contrast controllers 117, 118.

The switching-over between the image for display in superposition and the base image is performed by adjusting the brightness or the contrast of both images. In demonstrating the image for display in superposition, the image for display in superposition is displayed brightly, whereas the base image is displayed dimly.

If conversely the base image is to be displayed, it suffices if the image for display in superposition is displayed dimly, whereas the base image is displayed brightly.

The user actuation (manipulation), detected by the image switching unit 112, is first sent to the controller 111, which then issues a switching command to the brightness/contrast controllers 117, 118.

The switching command is sent to the brightness/contrast controllers 117, 118, which two brightness/contrast controllers 117, 118 operate in concert in case of image switching to realize smooth image switching.

Moreover, if the time or the time constant needed in switching command is also specified when issuing the switching command, it is possible to control the temporal quickness in the switching. If the switching time is control led in this manner, there is derived not only such an effect that the image switching appears more impressive to the viewer, but also such an effect that, since the image switching occurs continuously, positional clues may be memorized more readily in referencing to the original image when performing an operation under switching between the two images.

This memorizing of the positional clue can be reinforced by demonstrating the original image only dimly at the time of switching.

For such a usage in which routine processing suffices, the brightness/contrast controllers 117, 118 may execute the processing uniquely in accordance with a pre-set command. However, if more complex processing is to be performed or if a specified task is to be processed as the application software in its entirety, the brightness/contrast controllers 117, 118 operate under the command by the controller 111. It is also possible to change the brightness of the display device depending on the brightness in the room or to the using state of the input/output device.

This may realize such a control that, if the display device is not in use, the image plane is darkened to prevent burn spots or blotches in the device to realize a function equivalent to that of a screen saver, or that, if the input/output device is used in a light environment, the entire display is heightened in brightness to improve the visibility.

If a half-mirror is used as the superpositional image display unit 124, the light from the display may be changed in reflectance on the half-mirror, depending on the position of the viewing point of the user, such that the image plane displayed in superposition becomes bright or dark, depending on the viewing position. The function of correcting the variation in brightness is also effective in order to improve the visibility of the image plane. In this case, the image plane displayed in superposition may be maintained to a constant brightness by detecting the viewing point of the user to cause the brightness of the image plane displayed in superposition to follow the movement of the viewing point of the user.

The image switching unit 112 is used for setting which of the image displayed in superposition and the base image is to be presented to the user, or whether the two images are to be presented to the user, and is constituted by, for example, a switch, an analogous device or input device; or by input device capable of specifying a quantity or a ratio, such as a rotary encoder, a variable resistor, a pressure sensor or an acceleration sensor.

A case of stepwise image plane switching is explained. This stepwise image plane switching may be realized by changing the brightness ratio of the image for display in superposition and the base image.

If a switch is used as the image switching unit 112, plural switches are arranged and different numerical values are allocated stepwise to these switches or the quantities or ratios are allocated to the number of times of button pressing to specify the lightness of the image plane. Alternatively, it is possible to provide such functions as specifying the quantities or ratios from the time during which the button is pressed or the time as from pressing until releasing the button, or allowing the numerical values to be decreased or increased after lapse of a certain preset time as from the time point the button is pressed to realize stepped switching of the image planes.

It is also possible to use, as image switching unit 112, a technique of measuring the user position or recognizing the gesture or the speech (voice) of the user using an image recognizing technique, or a pressure sensor set on a floor surface to detect a person lying thereon, or a variety of sensors and detection devices, such as an infrared sensor, an ultrasonic sensor or a an acoustic (or video) speech sensor to detect a person approaching or to measure the distance to the apparatus, to convert the information pertinent to the operation of a human being or commands into discrete numerical figures and to apply the resulting numerical figures for controlling the brightness/contrast controllers 117, 118 to effect stepped image plane switching.

The controller 111 performs variable control and management, such as supervision of the superposing information or designation of an area for superposition;

effect management or designation;

control for switching between the image displayed in superposition and the base image;

control of the brightness/contrast controllers;

adjustment or control of the display demonstrating position (or level); and management of an input device. The controller 111 also communicates with an application software and with an external equipment to manage control of the entire apparatus for executing a specified task.

The terminal unit 120 displays an image and detects an input from a user. The brightness/contrast controllers 117, 118 send images 23, 24 which are demonstrated on the displays 122, 123, respectively.

The display position adjustment mechanism 121 adjusts the position of demonstration on the display 122 or 123 in accordance with a command by the controller 111.

The input device 125 detects an input by the user to send the input information to the controller 111, which controller 111 transmits the input information to a preset site, such as by routing the input information to an application software.

As the displays 122 or 123, a device emitting the light and/or a device for reflecting extraneous light to demonstrate the information, such as CRT (cathode ray tube);

LCD (liquid crystal display);

PDP (plasma display panel);

a projector;

an LED (light-emitting diode) display device; or

EL (electroluminescence) display device, or else may be used.

The display may be such a one in which the printed matter such as photos, drawings or documents are arrayed and automatically interchanged by manual or mechanical operations to display the information in superposition to arrive at a targeted result. In such case, the printed article is illuminated and the brightness of the illumination is adjusted to adjust the brightness as a display. If a display by e.g., printed matter is illuminated by a projector, and an image projected on the printed matter is such a one in which the mask pattern is black, with the remaining portion being white, the image portion superposed with the superposing image becomes a shade, with the result that the superposing image can be demonstrated clearly even in case the printed matter is used as one of the displays.

As the superpositional image display unit 124, configured for superposed demonstration of the image projected on a display image plane, such display means configured for projecting a reflected image of an image plane on another image plane through a half-mirror; or such display means in which plural display devices each having a transparent display surface are stacked in cascade in the vertical direction may be used.

In the following, a configuration mainly employing a half-mirror is explained. The configuration employing a half-mirror has a merit that the information can be directly superposed on a conventional device such as a touch display, or that the information can be displayed in superposition on an actual physical device (pen tablet).

On the other hand, in the configuration comprising plural stacked-up transparent displays, the apparatus size can be compact. The transparent display device may be exemplified by e.g., a liquid crystal panel. If, in an apparatus in need of backlighting, such as a liquid crystal panel, another image plane is demonstrated between the backlight and the targeted display image, the image plane sandwiched in-between sometimes acts as a mask for the backlight and the targeted display image to render it impossible to obtain a clear image. For avoiding this, it suffices to use devices, such as EL or LED, that can be used in superposition one on others, in which case the display interposed between the blacklight and the targeted display image realizes image superposition more effectively.

The display position adjustment mechanism 121 furnishes the function of adjusting and holding the display position (level) or the position of observing the picture (image) demonstrated on the display. Any optional means may be used as the display position adjustment mechanism 121 if such means permit adjustment of the display position and also permit the display to be secured at a desired position. For example, the display position adjustment mechanism 121 may be designed so that the display is slid on a rail and a display supporting site on the rail can be fixed as appropriate.

If the display position adjustment mechanism 121 not only has the function of adjusting the display position before using the apparatus but also has the function of dynamically changing the display position during use, it becomes possible to change the image plane position during use, thereby enabling the latitude (scope) of demonstration in superposition to be increased additionally.

For an application in which the displays 122, 123 and the superpositional image display unit 124 are fixed, it is not mandatory to provide the display position adjustment mechanism 121 capable of such dynamic adjustment.

In the system employing a half-mirror, in which the relative positions (distance) between image planes can be changed freely, it is possible to change the imaginary vertical relative positions of the image planes or to display the plural image planes in the same plane.

If the display position adjustment mechanism 121 is mounted on each of the displays 122, 123, it is possible to raise the speed of relative image plane movement to enable the image position to be changed quickly.

In the system employing a half-mirror, the position or the angle of the half mirror is adjusted by the display position adjustment mechanism 121. By inter linking the control of the display position and the half-mirror adjustment, the display position in the apparatus can be changed, whilst the casing of the apparatus can be deformed with the display state remaining unchanged, depending on the usage or the objective, or the relative picture positions can be changed dynamically.

For example, if the base image is arrayed parallel to the wall surface, the image for display in superposition is preferably arranged at right angles to the base image, in which case the image plane visibility may be higher. If the base image is arranged parallel to the floor surface, as when the image plane is placed horizontally on a table, the base image and the image for display in superposition are frequently arranged preferably parallel to each other. In the former case, the half-mirror is arranged at an angle of 45° between the base image and the image for display in superposition, whereas, in the latter case, the half-mirror is arranged parallel to the base image.

Since the optimum relative position is derived in relation to the setting conditions of the apparatus and to the position and posture of observation of the user, it is desirable that the relative display positions as well as the half-mirror position and angle can be changed and set freely.

In the system employing the half-mirror, the reflectance or the angle of the image p lane sometimes appears to be changed depending on the position of the user. However, by detecting the viewing point of the user and by causing the angle of the image plane to dynamically follow the viewing point of the user, it is possible to correct the image plane for tilting, to cause the superposing image to appear to be displayed at a constant relative position with respect to the base image at all times.

An actuating device, routinely used as an input device for the information processing apparatus, may be used as the input device 125. Examples of the input device 125 include a keyboard or the like device, mouse or an analogous pointing device, a touch panel, a pen tablet or an analogous device, a speech recognition device and an image recognition device.

If, in the present embodiment, a touch display is used as a display, apparent projections or recesses in the button, or a animation of an apparently yielded button on button pressing, not possible with the conventional touch display, may be demonstrated, thus improving the operational feeling. The present embodiment also is effective for a usage in which a pen tablet with a drawing pasted thereon is arranged in one of the displays and displayed in superposition on another image.

Also, in the present embodiment, in which plural image planes are arranged in superposition, it is desirable to provide means for freely specifying an image plane to be acted on, that is means for freely moving the focus of operation o an image plane desired to be specified.

As a method for specifying the image plane,

- a method of causing automatic movement of the operating focus or cursor to an image plane activated by image plane switching means;
- a method of providing a key or a switch and allocating the image plane (portion) to be designated for each switch so that the focus or the cursor will shift to the image plane on thrusting (or touching) the switch;
- a method of specifying an image plane (or plane portion) by speech; or
- a method of detecting the viewing point or the point being viewed by the user to estimate the image plane (portion) the user is desirous to act on to select a focussed image plane (portion) may be used.

There are also a method of moving a cursor displayed on the image plane to within a selected image plane (or area), on designation of the image plane (or area), and a method in which, if an objet the user is interested in is superposed on a pointing device, a focus or cursor is moved to the object. The former method is effective when the image-plane is switched and an image plane mainly displayed is specified, whereas the latter method is effective when plural image planes are demonstrated equally and simultaneously.

If plural objects and information are present on a straight line interconnecting the pointing device and the viewing point, auxiliary designating means employing a switch, a key or the speech are provided to enable an object to be specified.

A second embodiment of the present invention is explained. FIG. 2 shows the structure of the present second embodiment. Referring to FIG. 2, showing the image superpositional display type information input/output apparatus according to the second embodiment of the present invention, an image generating unit 100A includes an superposing information analysis unit 200, an superposing image generating unit 201, and a mask pattern generating unit 102. The image generating unit 100A is fed with an superposing information 26 and with a reference image 25.

The base image generating unit 115 is fed with an output of the effector 114 and with the reference image 25. The remaining units, namely the control unit 110 and the terminal unit 120, are similar in structure to the corresponding units in the above-described embodiment of FIG. 1 and hence are not shown in FIG. 2.

In the present embodiment, the superposing information 26 is given in other than an image form. The superposing information analysis unit 200 generates the superposing image generating information 14 to route the generated information to the superposing image generating unit 201, while generating an superposing (superposition) area designating information 15 to route the generated information to the mask pattern generating unit 102.

The superposing image generating unit 201 generates the superposing image, in accordance with the superposing image generating information 14, to route the generated superposing image to the effector 113.

The superposing position designating information 13, sent from the controller module 111, indicates the display position of the superposing image with respect to the reference image. The superposing position designating information 13 is expressed by, for example, coordinate values in the reference image, such that display in superposition is performed with representative points of the superposing information coinciding with the coordinate values.

As the representative points of the superposing image, one of the apex points of a rectangle surrounding the superposing information, expressed as an image, such as a center point and a reference point, for example, is selected. For designating the superposing position, there may be included a control information for generating the information image from the superposing information.

The superposing image generating information is the information necessary for the superposing image generating unit 201 to generate the superposing image, and may be exemplified by the image generating sequence in the superposing image generating unit, created from the results of analysis of the species or attributes of the superposing information.

For example, if the superposing information is given as letters, the superposing image generating information also contains the letter positions on the image plane, character codes, fonts, sizes and, if there lacks font data in the superposing image generating unit 201, font data etc.

If the superposing information is graphic data, vector data, polygon data, pixel data, and raster data for a raster image to be expanded on a video memory represent the superposing image generating information.

FIG. 3 shows the structure of a third embodiment of the present invention. In FIG. 3, an image generating unit 100B in the superpositional image display type information input/output apparatus, according to the third embodiment of the present invention, includes an superposing image analysis unit 300 and a mask pattern generating unit 102. The image generating unit 100B is fed with an superposing image 27 and a reference image 25, whilst the base image generating unit 115 is fed with an output of an effector unit (b) 114 and with the reference image 25. The other components or units, namely the control unit 110 and the terminal unit 120, are the same as those of the embodiment shown in FIG. 1 and hence are not shown in FIG. 3.

In the present embodiment, the superposing information is given as an image. An superposing image analysis unit 300 generates the superposing area designating information 17, in accordance with the superposing position designating information from the controlling unit 111, to send the generated information to the mask pattern generating unit 102.

If the superposing image 27 is given with the same size of format as those of the reference image 25, with the position of the demonstration in superposition having been set, the superposing image analysis unit 300 generates the superposing area designating information.

If the superposing image has already been masked in black for port ions other than the area for the superposing information, the superposing picture analysis unit 300 directly sends the superposing image to an effector unit (a) 113.

On the other hand, if the superposing image 27 has not been masked as appropriate, the superposing image analysis unit 300 applies a masking processing.

The superposing image analysis unit 300 analyzes the shape of the superposing image and the superposing position and generates the superposing area designating information 17 to route the generated information to the mask pattern generating unit 102.

If the superposing image 27 differs from the reference image 25, and the position for demonstration in superposition is set, the superposing position designating information 16 is sent from the controller module 111. In accordance with this superposing position designating information, the superposing image analysis unit 300 performs the masking, trimming or processing including image size change or image movement, to route the resulting processed image to the effector unit (a) 113.

The superposing image analysis unit 300 also analyzes the shape of the superposing image and the superposing position and generates the superposing area designating information 17, as it refers to the superposing position designating information 16, to route the generated superposing area designating information 17 to the mask pattern generating unit 102.

FIG. 4 shows the structure of a fourth embodiment of the present invention. In this figure, the image generating unit 100C in the superposing image display type information input/output apparatus according to the fourth embodiment of the present invention is made up only of the mask pattern generating unit 102. The image generating unit 100C is fed with the superposing image 27 and with the reference image 25, the superposing image 27 is input to the effector unit (a) 113, whilst the base image generating unit 115 is fed with an output of the effector unit (b) 114 and with the reference image 25.

The structures of the control unit 110 and the terminal unit 120 is otherwise the same as those of the previous embodiment, shown in FIG. 1, and hence are not shown in FIG. 4.

In the present embodiment, the superposing information is given as an image, the superposing image 27 is given with the same size or the same image format as the reference image 25, and the position of demonstration in superposition is pre-set.

In this case, the area other than the superposing information is masked in e.g., black. If this is not the case, image processing as required for demonstration in superposition is performed in the effector unit (a) 113.

On the other hand, the controller module 111 holds characteristics of the superposing image at the outset and generates the superposing area designating information 18 to route the generated information to the mask pattern generating unit 102.

This embodiment is effective in lowering production cost in that, when the superposing image 27 is of a pre-set shape or is demonstrated in superposition in a preset area on the reference image, the embodiment may be simplified in structure.

The operation of an embodiment of the present invention is hereinafter explained with reference to a particular concrete embodiment.

The image size can, in general, be represented by the numbers of pixels in the vertical and in the horizontal directions. If the original image is given by analog signals, or if the image transmission between respective processing blocks is effected with analog signals, the image size may be assumed to mean the same image signal standard.

The image plane size means the physical size of two image planes represented on the terminal unit 120. In many cases, the size of the image plane (field or area) is represented in general by the size of a diagonal line of a display plane. If the demonstration in superposition is to be handled, as in the present invention, the same information represented on each display needs to be represented as a congruent or similar fashion in shape, except in case of aiming at a special rendition effect. Therefore, the image plane size needs to be compared and represented in terms of an area of actual information demonstration.

That is, the image plane size is to be represented by a real size of a rectangular area filled with specified pixels. In general, this rectangular area is represented as the maximum possible demonstration area in the display. Representative of these standards is the VGA (video graphics array), SVGA (super video graphics array) and XGA (extended graphics array).

If, when the information of the same shape is demonstrated on each of two displays, the representation is not congruent or similar and if the display side is unable to effect size adjustment, the demonstrated picture is multiplied with an appropriate ratio to make adjustment so that congruent or similar images will be displayed at the time of demonstration.

In a CRT, representation on an image plane differs appreciably from one image to another. Therefore, if a CRT is used as a display in the present invention, for assuring facilitated adjustment, image plane adjustment is indispensable. For facilitating the adjustment, displays having the same characteristics are preferably employed. Since the adjustment is facilitated with a test pattern demonstrated on the image plane, a pattern generator is enclosed in the inventive apparatus for demonstration as necessary. Such a test pattern is used which, like a checkerboard pattern having a constant square size, is useful in adjusting a projector or the CRT. Since the two image planes are demonstrated simultaneously for adjustment, different patterns are sent as respective image planes, or two different patterns which, when combined together, produce a sole pattern, are selected.

The pattern generator may be enclosed in the effectors 113, 114, matrix switcher 116, brightness/contrast controllers 117, 118 or in the displays 122, 123.

The ordinary image plane representation and a test pattern demonstration may be switched under a command from the controller module 111.

This test pattern may be used not only for adjusting the image plane size but also in effecting fine adjustment of the display position. It is noted that, if the test pattern is used for the purpose of fine position adjustment, the image plane size is first adjusted at a specified position of the display. It is also possible to affix a marker at each corner of the display plane or on a display casing to adjust the physical position or the optical axis of the display with the marker as an index. Such adjustment is easier to perform if the marker is of the type emitting light spontaneously. For adjusting the optical axis of the display plane, coherent light, such as laser light, is projected from a viewing point of a user towards the display plane and respective display positions may be adjusted so that light spots will be formed at the same positions on the two display planes.

If a liquid crystal display or a plasma display is used as a display, the image plane size which is physically well-nigh equal is obtained by employing the same display and the same image plane resolution. This assures easier image plane adjustment than in a CRT to give rise to designing and operating merits.

If a half-mirror is used as the superposed image display means 124, it is necessary to cause light reflection by the half-mirror to invert the image to be viewed. For inverting the image plane, it may be inverted on the display or by the effector unit (a) 113.

For inverting the image by the display, which is, e.g., a CRT, the image plane scanning direction may be inverted in the left-and-right direction to effect image plane inversion. For inverting the image by this effector unit, the image plane may be inverted by saving the image in a frame memory and by setting the readout sequence from a memory so as to invert the image plane in reading out the image from the frame memory. This image plane inverting method employing this frame memory may be effected in the display.

The superpositional image display unit 124 and the display position adjustment mechanism 121 are explained in detail. FIG. 5 shows the structure of the terminal unit 120 when a half-mirror is used as the superpositional image display means 124.

In FIG. 5, a base image and an image for demonstration in superposition are demonstrated on a display (a) 123 and on a display (b) 122, respectively. The image demonstrated on the display (b) 122 is reflected by a half-mirror 124 to get to the user. Therefore, it appears to the user that the reflected image of the display (b) 122 is demonstrated floated over a display screen of (i.e., image plane) of the display (a) 123.

The distance between the display (a) 123 and the reflected image is adjusted by the display position adjustment mechanism 121.

As a half-mirror, such a half-mirror manufactured by depositing a metal film of a suitable thickness on a transparent glass sheet by means such as vapor deposition is used. An optical component attenuating the transmitted light, such as a smoked glass sheet or an ND filter, may also be used as a half mirror. A high molecular (polymer) film, carrying a thin metal film thereon, also operates as a half-mirror. Although these optical components are desirably planar, it is also possible to demonstrate the components as concave surfaces or as convex surfaces in order to intentionally enlarge or contract a reflected image to display an enlarged or contracted image, respectively. In general, a glass substrate of a half-mirror, which is as thin in thickness as possible insofar as a sufficient strength is maintained, is preferred in order to obtain a clear reflected image, by eliminating double-imaged appearance of a reflected image.

Figure 6:
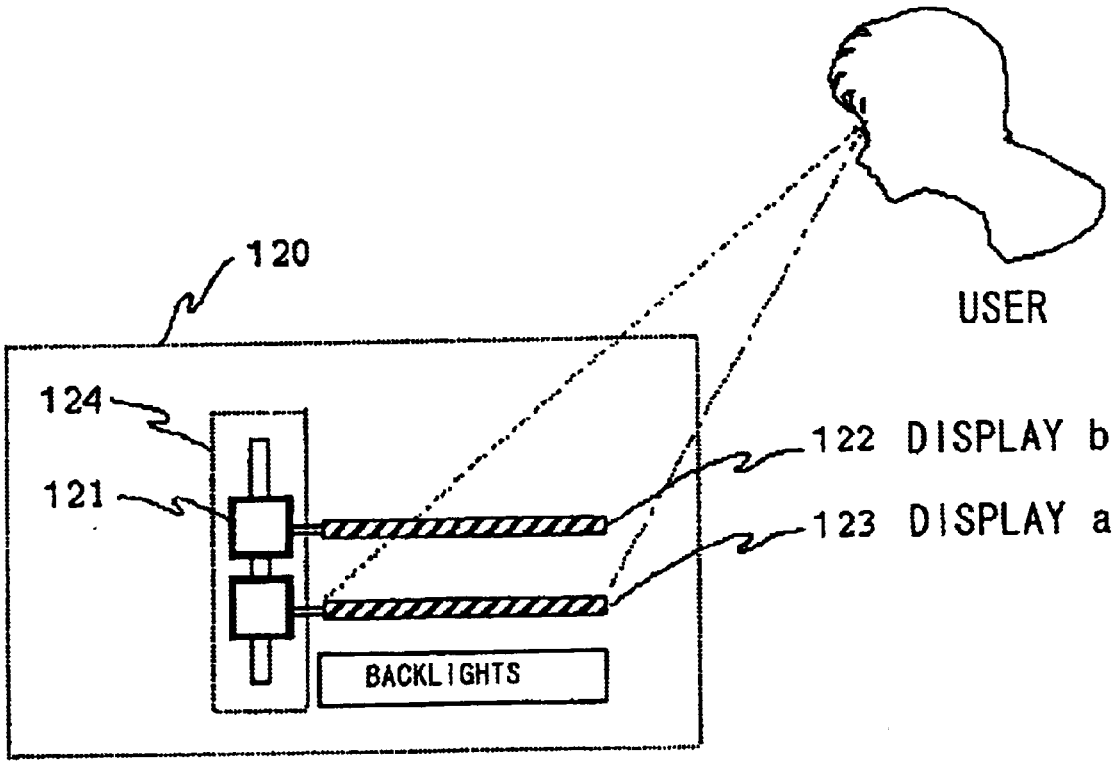
FIG. 6 illustrates the structure of a terminal unit in case of using a stacked transmission displays as an image superpositional display unit in the first embodiment of the present invention.

FIG. 6 shows the structure of the terminal unit 120 in case a stack of transmission type displays is used as the super positional image display means 124. In FIG. 6, a base image and an image for demonstration in superposition are demonstrated on the display (a) 123 and on the display (b) 122, respectively. The image demonstrated on the display (a) 123 is transmitted through the display (b) 122 to get to the user. Therefore, it appears to the user that the image on the display (b) 122 is demonstrated floated over the display (a) 123. The distance between the display (a) 123 and the image on the display (b) 122 is adjusted by the display position adjustment mechanism 121.

If the transmission type display is not a device emitting the light spontaneously, a backlight, for example, is arranged at the back of the display (a) 123.

If, when the image for demonstration in superposition and the base image are to be generated from the original image, the original image, the image for demonstration in superposition and the base image are generated so as to be of the same size, it is possible to use a common coordinate system for the entire images, with the result that the processing for the entire apparatus can be executed concisely.

If the two images displayed on the terminal unit 120 differ from each other, the image for demonstration in superposition and the mask pattern are generated to reflect the size ratio of the image planes.

The information for designating the superposing area 10 is hereinafter explained. The information for designating the superposing area 10, sent from the controller module 111 to the image generating unit 100, is the information specifying where on the original image or on the reference image the image for demonstration in superposition is displayed in superposition on the original image or the reference image. In extracting the image for demonstration in superposition from the original image, the information for designating the superposing area represents the information for specifying this area for extraction. The information for designating the superposing area is also used in generating a mask pattern synthesized on the original image or on the reference image.

If, when the superposing information and the reference image are given, the superposing information differs in size from the reference image, or a portion of the superposing information is extracted and displayed in superposition on the reference image, the information for designating the superposing area includes a command on the position of extraction or the extraction method to the superposing information and a command on the position of display in superposition on the reference image.

If the area desired to be displayed in superposition is rectangular, the information for designating the superposing area describes the coordinates of points specifying the rectangle in the original image as a set of these points. In designating a rectangle, it suffices in general if two points constituting a diagonal line of the rectangle are specified.

If the area is a polygon, other than a rectangle, it suffices if coordinate points of respective apex points are specified. As for a figure that can be represented with only a small number of parameters, such as a circle, the figure, that is the area to be displayed in superposition, is specified by parameters consistent with characteristics of respective figures. There are also methods in which areas of an $\alpha$-channel of the original image is binary-coded with a specified threshold value to designate an area, or in which an area is designated by a location having a specified chromatic component in the image.

It is also possible to designate a memory address in case of capturing an original image in a video memory, or to provide an image of the same size as the original image and to draw pixels of specified values in an area to be designated.

If the area to be displayed in superposition or if its size is fixed or represented by finite parameters, the information for designating the superposing area is represented by the coordinates of the representative points of the specified shape and by parameters representing multiplication factors. There are also occasions where an area can be specified by designation of or reference to previously allocated numbers or symbols.

For example, if, in an image plane of Windows (registered trademark), a specified window is to be displayed in superposition, the information for designating the superposing area may be specified by the information specifying the window demonstrated in superposition. In such case, the information specifying the window to be displayed in superposition is handed over through e.g., a function to an inner program supervising each window to make an inquiry which area of the original image or the reference image is to be displayed to obtain an actual coordinate value.

Any other optional information, capable of specifying a particular area in an image, may be used as the information for designating the superposing area.

The information for designating the superposing area may be issued from the controller module 111 or sent a long with the superposing information from the outside. The information for designating the superposing area is issued by the controller 111 when the apparatus itself supervises the area in which to display the information in superposition, or when a command pertinent to the demonstration in superposition is transmitted from outside the apparatus to the controller module 111. In the former case, the position for display in superposition is perpetually determined and the area in which to make display in superposition or the shape of the display in superposition is fixed. In the latter case, a window in which to make display in superposition is to be specified in an application software. In this latter case, the superposing information is frequently displayed in a preset area (or region) on the image plane, irrespective of the superposing information.

The information specifying the site for display in superposition is sent from the application software to the controller module 111 where it is converted to the superposing area specifying information which takes the characteristics proper to the apparatus and the coordinate system into account.

The information pertinent to the designation of the superposing area is sent from outside along with the superposing information when the position information is contained in the superposing information itself; and when the information pertinent to the designation of the superposing area is sent separately from the superposing information.

For the case in which the position information is contained in the superposing information itself, there are a method in which the superposing information itself is sent as an image, with the image size which is the same as the size of the reference image, in a state in which positioning for superposing display has come to a close, and a method in which the superposing information is sent along with the superposing information arraying sequence to generate the superposing image, for example, a method in which data of the information to be displayed in superposition is sent along with the coordinate values used for arraying the information on the image plane.

The method for displaying the image for demonstration in superposition on the base image is explained in detail.

First, the case of extracting the image for demonstration in superposition from the original image is explained.

For emphasizing a specified area in the original image, the specified area is extracted and demonstrated in superposition so that the area appears as if it is floated up or sunk from the base image.

To this end, it is necessary to designate which portion in the original image is to be extracted. It is the information for designating the superposing area which specifies this area in the original image.

The generation of an superposing image in the superposing image extraction unit 101 is explained.

Assume that the original image is made up of 640×480 pixels and the superposing information is 50×50 pixels with a specified position in the original image as a base point. An superposing image is obtained by extracting 50×50 pixels from the original image followed by overwriting an image of 50×50 pixels, as the superposing information, on an image of 640×480 pixels as in the original image, with the entire pixels being black pixels with the pixel value of 0, in accordance with a base point which is the same as that of the original image.

The generation of a mask pattern and the synthesis of the mask pattern with the image to be superposed are explained in detail.

If the $\alpha$-plane of each pixel is made up of eight bits, the structure of the simplest mask is such an image in which a masked portion (area) is of the $\alpha$-value equal to 0 and the remaining area has a value of 255.

This image may be ANDed (logical multiplication) with respect to the image to be superposed to apply a masking effect to a site corresponding to the superposing image. Each pixel of the image to be superposed, corresponding to the mask pattern, may be multiplied with a coefficient k ($0 \leqq k \leqq 1$) to decrease the luminosity of the portion in question of the image to be superposed, instead of being processed with the logical procuct processing, as described above.

If the α-value of the mask pattern is 0 and the masking by logical product is applied, the processing operation is simple, such that the processing is completed quickly. However, the information of the masked portion of the image for display in superposition is all black such that the information becomes invisible.

If now the mask pattern is formed by a partially masking hatching pattern, such as a checkerboard pattern, and the image. for display in superposition is masked, it is possible by simple logical calculations to lower the apparent luminosity without causing loss of the entire information of the image to be superposed by masking.

If a half-mirror 124 is used, as shown in FIG. 5, and the user directly acts on the display (a) 123 by a manual operation, the user's hand is interposed between the user and the display 123. However, since the reflected image of the display (b) 122 is not hidden with a hand, there are occasions wherein, even if the hand is at a more recessed position than the reflected image, the superposing image is displayed on the hand. In such case, the shape of the user's own hand, as seen from the user, may be generated as a pattern, and the superposing image may be masked in the effector unit 113 to alleviate the extraneous feeling.

By dynamically changing the image extraction pattern in the superposing image extraction unit 101 or the area of the superposing image, and by correspondingly changing the mask pattern to mask the original image or the reference image, it is possible to switch wiping between the image for display in superposition and the base image.

By registering the change as a wipe pattern in the controller module 111 etc. and by designating the registration number, change rate, switching start point or the pattern position, image plane switching can be realized effectively.

In case the image plane sizes of the two displays 122, 123, represented by the terminal unit 120, differ from each other, the image for display in superposition and the mask pattern are generated in such a manner as to reflect the image plane size ratio so that the image for display in superposition and the mask pattern will appear to be of the same size, should these be displayed respectively.

The manner in which the superposing image is synthesized and demonstrated is hereinafter explained.

Figure 7:
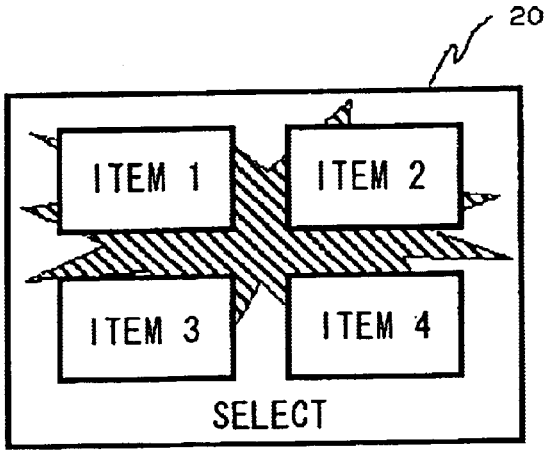
FIGS. 7(*a*)–7(*d*) schematically shows an example of an image for illustrating the operation of an embodiment of the present invention.
Figure 7:
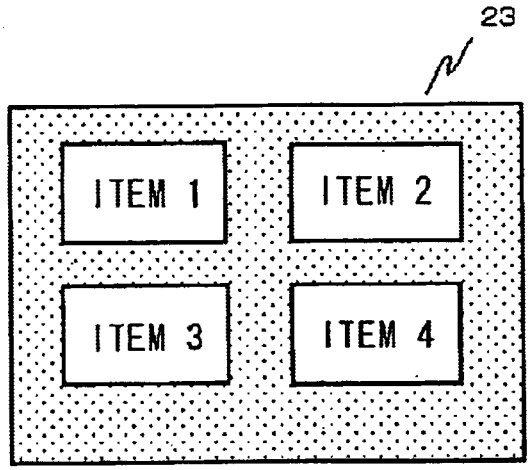
Figure 7:
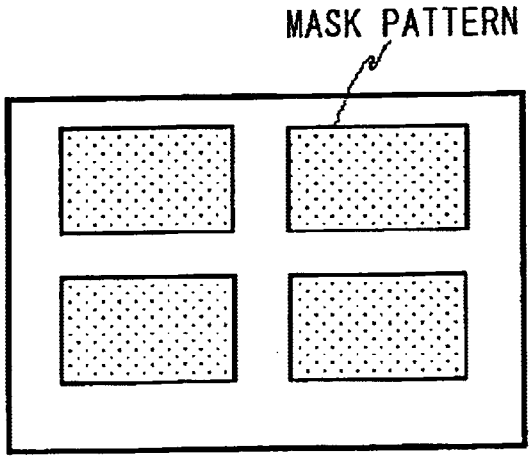
Figure 7:
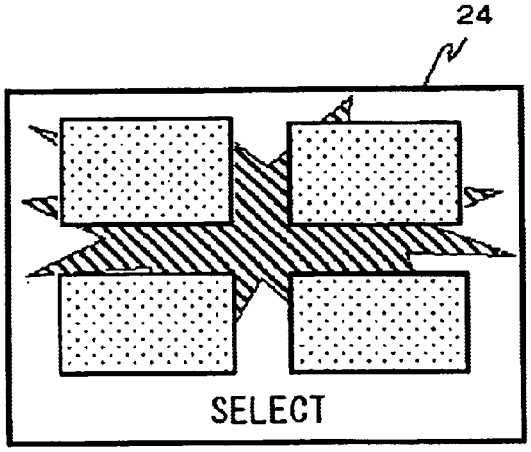

In an embodiment shown in FIG. 7, it is assumed that the two image planes observed by a user are arranged at a suitable relative spacing from each other; such as 0.5 to 3 cm for an image plane (screen) of 15 to 17 inches in size. This spacing depends on the image plane size or usage. If the spacing (distance) is too narrow, the floating feeling can hardly be produced, whereas, if the spacing is excessive, the correlation between the two image planes is lowered. For enabling the superposing information to be handled like a button, and for producing a display effect such that the display of the same information is being switched in operation between the image for display in superposition and the base image to produce the feeling that the information is floating, raised or recessed, it is effective to design the above-mentioned spacing in a range from 1% to 10% of the diagonal line of the image plane.

FIG. 7 shows an example of an image in one embodiment of the present invention. FIG. 7*a* shows an example of an original image. This image contains a figure of a rectangle from "item 1" to "item 4" and represents buttons displayed on a touch panel image plane (screen).

The controller module 111 holds the information on the shape, positions on the image plane and on the areas of the four rectangles, and specifies on which area information is to be extracted from the original image to the superposing image extraction unit 101 as the superposing area designating information 10.

FIG. 7*b* shows an image obtained by extracting the superposing information from the original image to form the superposing image, in accordance with the information for designating the superposing area 10. If the area other than the superposing information is black in color, for example, if the values of R, G and B are all 0 or near 0, subsequent image processing is facilitated. In the case of the superposed image display means 124, employing the half-mirror, solely the superposing information can be displayed in superposition on the base image simply by demonstrating this superposing image on the display. It is noted that, in FIG. 7, "black" is represented by "dots".

FIG. 7*c* shows an example of a mask pattern. In setting the mask pat tern, it is possible to use black pixels and non-black pixels for the masked portion and for the unmasked portion, respectively, or to use non-black pixels and black pixels for the masked portion and for the unmasked portion, respectively.

The mask pattern is at the same position as that of the superposing information on the original image. The purpose of doing this is to erase the display on the original image side in the superposing portions of the superposing information and the original image produced on superposing the, superposing information on the original image. This processing gives such a result that the superposing information is extracted and floated from the original image.

In emphasizing the floating effect, the boundary of the mask pattern is blurred by an image processing filter, such as a Gauss function, to give a so-called "drop-shadow" effect as if the shadow of the superposing information is projected on the original image. The method for effective blurring may be set from factors, such as type, number and/or position of virtual light source, ambient illumination or relative positions between the original image and the superposing information.

FIG. 7*d* shows a base image obtained on synthesizing a mask pattern of FIG. 7*c* with the original image of FIG. 7*a* and on masking. This base image is,such an image in which only the superposing information in the original image is painted in black.

Figure 9:
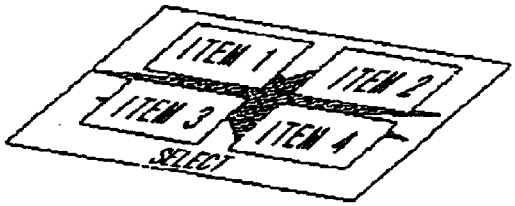
FIGS. 9(*a*)–9(*d*) schematically shows a state of superpositional display in an embodiment of the present invention.
Figure 9:
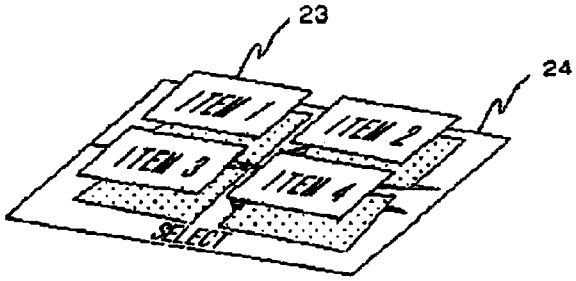
Figure 9:
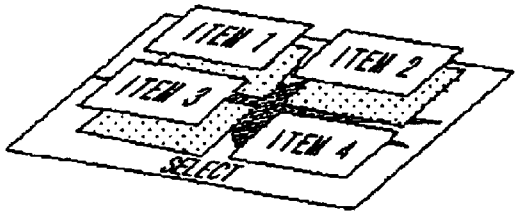
Figure 9:
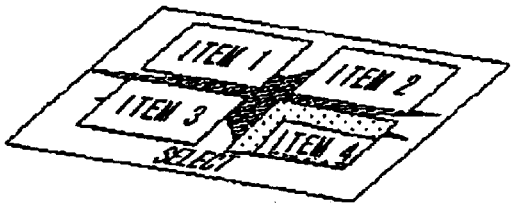

FIG. 9*b* shows a representation obtained on superposing demonstration with the image of FIG. 7*b* as an image for demonstration in superposition and with the image of FIG. 7*d* as a base image. This representation is such a one in which is shown floated only the portion of the superposing information of FIG. 9*a* as an original image.

Figure 8:
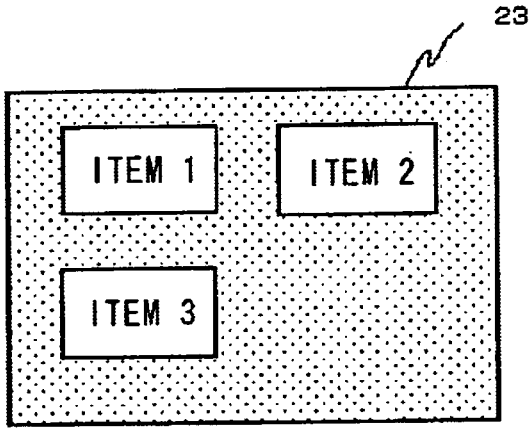
FIGS. 8(*a*)–8(*b*) schematically shows an example of an image for illustrating the operation of an embodiment of the present invention and particularly shows the state following selection of an item.
Figure 8:
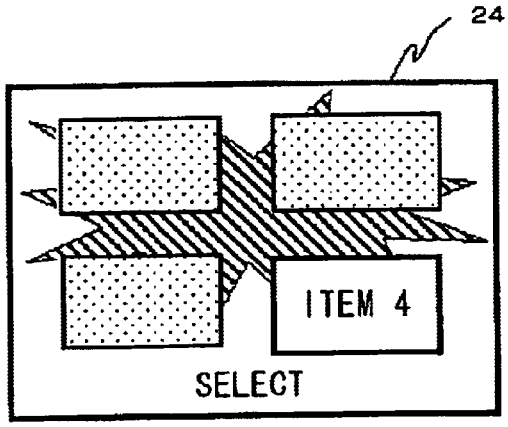

FIG. 8 shows an example of an image in an embodiment of the present invention showing the state following selection of an item. In such case, the selected item is caused to appear to be reverted to the original image from the floating state in order to create a physical cause/result rule as if the information area is pressed and recessed. If this effect is intended, the superposing information is the portion excluding the selected "item 4", as shown in FIG. 8*a*. Simultaneously, the mask pattern is a so co-extensive as the area indicated in FIG. 8*a*, so that a base image results in an image including the portion of the "item 4", as shown in FIG. 8*b*.

If the image for demonstration in superposition and the base image are viewed in superposition to each other, an image shown in FIG. 9*c* is obtained. On the other hand, if the "item 4" is selected in FIG. 9*b*, an image shown in FIG. 9*c* is obtained to give rise to an effect as if the item 4 is pressed and recessed, thus providing an interface which is intuitively more comprehensible than the case where the item is selected on a conventional image plane shown in FIG. 9*a*.

FIG. 9*d* shows an image produced when the position of the image for display in superposition is more recessed than that of the base image.

Thus, in the apparatus of the present embodiment, an image plane can be arranged at an optional position above and below the base image to realize the representation of virtual crests and recesses.

Although the image for display in superposition and the base image are located on upper and lower sides as seen from the user in the aforementioned disclosure, such designing is possible in which the base image and the image for demonstration in superposition are on the upper side and lower side, respectively.

The same display effect may be realized by setting the mask pattern appropriately even if the vertical position relationship between the image for display in superposition and the base image is reversed. For example, FIGS. 7*b* and 7*d* may represent the base image and the image for display in superposition, respectively. In this case, the mask pattern of FIG. 7*c* may be inverted to apply masking to the portion of the original image.

It is to be noted that the above-described respective embodiments are intended for illustrating the present invention without limiting its scope, and that the present invention encompasses a wide range of variations within the scope of the invention.

The meritorious effects of the present invention are summarized as follows.

The present invention described above gives the following meritorious effects:

The first effect of the present invention is that the information demonstrated on a sole image plane in the conventional practice can be more comprehensible and is such as spontaneously guides the user attention to the information of interest.

The second effect is that, even if a number of information is displayed on a sole image plane, the user is able to grasp clearly where his or her attention should be drawn and where the focus (emphasis) is placed, and that, even if the information or the window are superposed together, the underlying information may be seen to some extent to facilitate information retrieval and to permit facilitated reciprocal information referencing to present a display environment having superior overview properties.

The third effect of the present invention is that, in the window representation, plural windows can be demonstrated simultaneously with the original size, while it is unnecessary to activate the underlying window for referencing to the underlying information, from one reference to another, thus improving operability and tractability.

The fourth effect of the present invention is that, in reciprocal referencing to plural windows, the distance through which the viewing line of the user in operation is moved comparable to that in case of a single image plane thus relieving the operator of the operating load, as compared to the conventional case of handling plural image planes.

The fourth effect of the present invention is that an operating environment with a higher operating feeling can be obtained without specifically improving the general GUI of a computer or a communication terminal to say nothing of the application software employing the touch panel display. According to the present invention an operating feedback with more realistic feeling can be presented by pressing a button image on an image plane.

The fifth effect of the p resent invention is that, due to a adjustment of blightness or contrast of the image plane and to the dynamic masking controlling function for the portion of demonstration in superposition, the image for display in superposition and the image plane to be superposed with the superposing image can be effectively demonstrated in superposition to present a readily visible and comprehensible display environment.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A superpositional image display type information input/output device comprising:

(a) an image generator unit generating a first image for display in superposition and a second image to be superposed from a given image; and (b) a superpositional image display unit providing a first display image plane of the first image for display in superposition and a second display image plane of the second image to be superposed in separated levels from each other in a superposed state such that the first image for display in superposition will appear to be floated on or recessed from the second display image plane of the second image to be superposed, wherein said image generator unit comprises:

a mask pattern generating module generating a mask pattern for the first image for display in superposition; and an image generating module generating the second image to be superposed from said mask pattern and said given image.

2. A superpositional image display type information input/output device comprising:

(a) an image generator unit that extracts a portion of an image to be displayed in superposition from a given image to output an extracted image portion as a superposing image, and that generates a mask pattern for said superposing image;

(b) a first effector unit that receives said superposing image output by said image generator unit, processes the received superposing image with designated image processing in accordance with effect designating information, to output the processed superposing image;

(c) a second effector unit that receives said mask pattern output by said image generator unit, processes the received mask pattern with designated image processing in accordance with the effect designating information, to output the processed mask pattern image;

(d) a base image generating unit that synthesizes the mask pattern image output by said second effector unit and said given image to generate and output a base image; and (e) a superpositional image display unit that superpositionally displays said processed superposing image and said base image as demonstrated on first and second display image planes.

3. The superpositional image display type information input/output device as defined in claim 2 wherein said superpositional image display unit comprises a half-mirror and demonstrates the superposing information in superposition on a base image as a reflected image of an image of an superposing information demonstrating a display image plane at a different level from that of the base image.

4. The superpositional image display type information input/output device as defined in claim 3 wherein said first and second display images are displayed by first and second displays, respectively, said first display being arranged facing a first surface of said half mirror, and said second display being arranged facing a second surface of said half mirror opposite to the first surface.

5. The superpositional image display type information input/output device as defined in claim 2 wherein said superpositional image display unit comprises first and second transmission type displays, and wherein said superposing information is displayed in superposition on said base image.

6. The superpositional image display type information input/output device as defined in claim 2 wherein said superpositional image display unit causes the image plane for display in superposition demonstrated on said first display at a position floated over or receded from the base image plane demonstrated on said second display.

7. The superpositional image display type information input/output device as defined in claim 2 wherein said display for demonstrating said base image is a display provided with a touch device.

8. The superpositional image display type information input/output device as defined in claim 2 wherein said first and second displays each comprises a light emission display device or a light reflection display device.

9. The superpositional image display type information input/output device as defined in claim 2 wherein either one of said first and second displays comprises a printed matter.

10. The superpositional image display type information input/output device as claimed in claim 2 wherein said image generator unit comprises:

a superposing image extracting module configured for extracting an image portion to be displayed in superposition from an image to be displayed in superposition, in accordance with a superposing area designating information for designating a superposing area on an image, to output an extracted image as the superposing image; and a mask pattern generating module configured for generating a mask pattern based on said superposing area designating information.

11. The superpositional image display type information input/output device as claimed in claim 2 wherein said image generator unit comprises:

a superposing information analyzing unit generating the superposing image generating information necessary for generating a superposing image and the superposing area designating information in accordance with the superposing position designating information given as information other than an image;

a superposing image generating unit generating and outputting a superposing image in accordance with said superposing image generating information; and a mask pattern generating unit generating a mask pattern based on said superposing image generating information.

12. The superpositional image display type information input/output device as defined in claim 2 wherein said image generator unit comprises:

a superposing image analysis unit receiving the superposing information as a superposing image to analyze the shape of said superposing image and a superposing position to generate and output the superposing area designating information in accordance with the resulting superposing position designating information; and a mask pattern generating unit generating a mask pattern based on said superposing area designating information.

13. The superpositional image display type information input/output device as defined in claim 2 wherein the superposing information is given as a superposing image with a size or an image format which is the same as a size or format of a given reference image, a superposing display position being pre-set, said superposing image being directly fed to said first effector unit;

said image generator unit comprising a mask pattern generating module generating a mask pattern based on said superposing area designating information.

14. The superpositional image display type information input/output device as defined in claim 2 further comprising:

a brightness/contrast controlling unit configured for adjusting the brightness and/or the contrast of said image for display in superposition and said base image depending on characteristics of said displays, to supply the resultant images to respective displays.

15. The superpositional image display type information input/output device as defined in claim 2 further comprising:

a switching unit switching over control of displays for said image for display in superposition output by said first effector unit and said base image output by said base image generating unit.

16. The superpositional image display type information input/output device as defined in claim 2 further comprising:

a switching unit switching over between said image for display in superposition output by said first effector unit and said base image output by said base image generating unit under adjustment of brightness and/or contrast of said images.

17. A superpositional image display type information input/output device comprising:

an image generating unit;

said image generating unit including an superposing image extracting unit extracting an image portion to be displayed in superposition from an image to be displayed in superposition, in accordance with an superposing area designating information for designating an superposing area on an image, to output an extracted image as the superposing image; and a mask pattern generating unit generating a mask pattern based on said superposing area designating information;

a first effector unit configured for receiving the superposing image output from said superposing image extracting unit to process the received superposing image in a specified manner based on an effect designating information to output an image for display in superposition;

a second effector unit configured for receiving the mask pattern output from said mask pattern generating unit to process the received mask pattern in a specified manner based on an effect designating information to output the resulting mask pattern image;

a base image generating unit synthesizing said mask pattern image output by said second effector unit and said original image to generate and output a base image;

a switching unit controlling to which one of displays of a terminal unit said image for display in superposition output by said first effector unit and said base image output by said base image generating unit should be supplied, respectively;

a brightness/contrast controlling unit adjusting the brightness and/or contrast of said image for display in superposition and the base image, sent from said switching unit, depending on characteristics of the display of said terminal unit, to send said images to the displays of said terminal unit;

an image switching unit configured for adjusting the brightness and/or contrast of said image for display in superposition output by said first effector unit and the base image output by said base image generating unit to effect switching control of said image for display in superposition and the base image; and a controller module sending said information designating said superposing area to said image generating unit, sending said effect designating information to each of said effector units, and designating the switching of said switching unit;

wherein said terminal unit includes:

a first display and a second display;

a display position adjustment mechanism adjusting and holding the position of said first and/or second displays or an image demonstrated on these displays;

a superpositional image display unit demonstrating said image for display in superposition and the base image in an superposed state on said first and second displays; and an input device.

18. A superpositional image display type information input/output device comprising:

(a) an image generating unit, (b) a control unit, and (c) a terminal unit;

wherein said image generating unit (a) includes:

(a1) an superpositional information analysis unit configured for generating superposing image generating information necessary for generating an superposing image and superposing area designating information, in accordance with the superposing position designating information, given as information other than an image;

(a2) an superposing image generating unit configured for generating and outputting an superposing image in accordance with said superposing image generating information; and (a3) a mask pattern generating unit for generating a mask pattern based on said superposing area designating information;

wherein said control unit (b) includes:

(b1) a first effector unit configured for receiving an superposing image output by said superposing image generating unit and for applying image processing designated based on an effect designating information to the received superposing image to output a resulting image for display in superposition;

(b2) a second effector unit configured for receiving a mask pattern output by said mask pattern generating unit for applying image processing designated based on the effect designating information to the received mask pattern to output a resulting mask pattern image;

(b3) a base image generating unit synthesizing the mask pattern image output by said second effector unit and a given reference image to generate and output a base image;

(b4) a switching unit controlling to which of displays of a terminal unit said image for display in superposition output by said first effector unit and said base image output by said base image generating unit should be supplied, respectively;

(b5) a brightness/contrast controlling unit adjusting brightness and/or contrast of said image for display in superposition and said base image sent from said switching unit depending on characteristics of displays of said terminal unit to send said image to the displays of said terminal unit;

(b6) an image switching-over unit adjusting the brightness and/or contrast of said image for display in superposition output by said first effector unit and the base image output by said base image generating unit to effect switching control of said image for display in superposition and the base image; and (b7) a controller module sending said information designating said superposing area to said image generating unit, sending said effect designating information to each of said effector units, and designating the switching of said switching unit; and wherein said terminal unit (c) includes:

(c1) a first display and a second display;

(c2) a display position adjustment mechanism adjusting and holding the position of said first and/or second displays or an image demonstrated on these displays;

(c3) a superpositional image display unit demonstrating said image for display in superposition and the base image in an superposed state on said first and second displays; and (c4) an input device.

19. The superpositional image display type information input/output device as defined in claim 18 wherein said superposing position designating information output by said controlling unit is an information specifying a display position of said superposing image relative to said reference image.

20. A superpositional image display type information input/output device comprising:

(a) an image generating unit, (b) a control unit, and (c) a terminal unit;

wherein said image generating unit (a) includes:

(a1) a superpositional image analysis unit to which is given superpositional information as an superposing image and which analyzes the shape and the superposing position of said superposing image to generate and output an superposing area designating information in accordance with a given superposing position designating information; and (a2) a mask pattern generating unit generating a mask pattern based on said superposing area designating information;

wherein said control unit (b) includes:

(b1) a first effector unit configured for receiving an superposing image output by said super positional image analysis unit and for applying image processing designated based on an effect designating information to the received superposing image to output a resulting image for display in superposition;

(b2) a second effector unit configured for receiving a mask pattern output by said mask pattern generating unit for applying image processing designated based on the effect designating information to the received mask pattern to output a resulting mask pattern image;

(b3) a base image generating unit synthesizing the mask pattern image output by said second effector unit and a given reference image to generate and output a base image;

(b4) a switching unit controlling to which of displays of said terminal unit said image for display in superposition output by said first effector unit and said base image output by said base image generating unit should be supplied, respectively;

(b5) a brightness/contrast controlling unit configured for adjusting brightness and/or contrast of said image for display in superposition and said base image sent from said switching unit depending on characteristics of the displays of said terminal unit to send said image to displays of said terminal unit;

(b6) an image switching unit configured for adjusting the brightness and/or contrast of said image for display in superposition output by said first effector unit and the base image output by said base image generating unit to effect switching control of said image for display in superposition and the base image; and (b7) a controlling module configured for sending said information designating said superposing area to said image generating unit, for sending said effect designating information to each of said effector units and for designating the switching of said switching unit; and wherein said terminal unit (c) includes:

(c1) a first display and a second display;

(c2) a display position adjustment mechanism adjusting and holding the position of said first and/or second display or an image demonstrated on these displays;

(c3) a superpositional image display unit demonstrating said image for display in superposition and the base image in a superposed state on said first and second displays; and (c4) an input device.

21. A superpositional image display type information input/output device comprising:

(a) an image generating unit, (b) a control unit, and (c) a terminal unit;

wherein said image generating unit includes a mask pattern generating unit for generating a mask pattern based on said superposing area designating information, provided that an superposing information is given as an superposing image, said superposing image is given in the same size or format as those of a given reference image and a position for display in superposition is preset;

wherein said control unit (b) includes:

(b1) a first effector unit configured for receiving an superposing image and for applying image processing designated based on an effect designating information to the received superposing image to output a resulting image for display in superposition;

(b2) a second effector unit configured for receiving a mask pattern output by said mask pattern generating unit for applying image processing designated based on an effect designating information to the received mask pattern to output a resulting mask pattern image;

(b3) a base image generating unit synthesizing the mask pattern image output by said second effector unit and said reference image to generate and output a base image;

(b4) a switching unit controlling to which of said displays of said terminal unit said image for display in superposition output by said first effector unit and said base image output by said base image generating unit are routed;

(b5) a brightness/contrast controlling unit adjusting the brightness and/or contrast of said image for display in superposition and said base image sent from said switching unit depending on characteristics of displays of said terminal unit to send said image to displays of said terminal unit;

(b6) an image switching unit adjusting the brightness and/or contrast of said image for display in superposition output by said first effector unit and the base image output by said base image generating unit to effect switching control of said image for display in superposition and the base image; and (b7) a controller module configured for holding characteristics of an superposing image at the outset, generating the superposing area designating information, sending the generated superposing area designating information to said mask pattern generating unit, outputting said effect designating information to each of said effector units and for designating switching of said switching unit; and wherein said terminal unit (c) includes (c1) a first display and a second display;

(c2) a display position adjustment mechanism adjusting and holding the position of said first and/or second displays or an image demonstrated on these displays;

(c3) a superpositional image display unit configured for demonstrating said image for display in superposition and the base image in an superposed state on said first and second displays; and an input device.

* * * * *